US006499277B1

(12) United States Patent
Warner et al.

(10) Patent No.: US 6,499,277 B1
(45) Date of Patent: Dec. 31, 2002

(54) COIN WRAPPER

(75) Inventors: David A. Warner, Williamsburg, VA (US); Sanjay A. Shivde, Bensenville, IL (US); Frank Csekme, Glendale Heights, IL (US); John Zygowicz, Niles, IL (US); John S. Lykowski, Glenview, IL (US); John F. Weggesser, Lake in the Hills, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 0 days.

(21) Appl. No.: 09/510,723

(22) Filed: Feb. 22, 2000

(51) Int. Cl.[7] ..... B65B 35/50
(52) U.S. Cl. ..... 53/447; 53/212
(58) Field of Search ..... 53/211, 212, 254, 53/465, 447

(56) References Cited

U.S. PATENT DOCUMENTS

| | | | | |
|---|---|---|---|---|
| 3,350,835 | A | 11/1967 | Becker | 53/66 |
| 3,603,327 | A | 9/1971 | Buchholz et al. | 133/8 R |
| 3,650,086 | A | 3/1972 | Puhahn et al. | 53/59 |
| 3,825,200 | A | 7/1974 | Puhahn | 242/57 |
| 3,863,425 | A | 2/1975 | Edwards et al. | 53/211 |
| 3,886,957 | A | 6/1975 | Ushio | 133/1 A |
| 3,899,864 | A | 8/1975 | Uchida | 53/212 |
| 3,905,176 | A | 9/1975 | Ushio | 53/212 |
| 3,906,964 | A | 9/1975 | Ushio | 133/1 A |

(List continued on next page.)

FOREIGN PATENT DOCUMENTS

| | | | | |
|---|---|---|---|---|
| AU | B-62789/86 | 3/1987 | | B65B/11/30 |
| CA | 2084459 | 12/1998 | | B65B/11/00 |
| DE | 3241796 A1 | 5/1983 | | B65B/11/04 |
| DE | 3145139 A1 | 6/1983 | | B65B/61/02 |
| DE | 4415367 A1 | 11/1995 | | G07D/3/16 |
| EP | 357 156 A2 | 3/1990 | | G07D/9/06 |

(List continued on next page.)

OTHER PUBLICATIONS

Electronic English Translation of JP 10–230905.*
Brochure: Glory WS–10—Compact Coin Counting and Wrapping Machine, 1 pg. (front & back).
Information entitled "Reis Eurosystems CW 2001 Operating Instructions," Standardwerk Eugen Reis GMBH, 140 pgs., date unknown.
Information from www.coinlogic.com entitles "Loading and Unloading CoinMates™" "Coin Logic Inc.—The Company" "The Ultimate CoinMate™" "The History of Coin Packaging," 14 pgs., date unknown (taken from website on Jun. 25, 1998).
Information entitled "Glory WR–400 WR–80 High Speed Coin Counting and Wrapping Automation," Glory (U.S.A.) Inc., 2 pgs., date unknown.
Information entitled "The Ultimate Coinmate™, " Coin Logic Inc., 6 pgs., date unknown.

*Primary Examiner*—John Sipos
*Assistant Examiner*—Louis Huynh
(74) *Attorney, Agent, or Firm*—Jenkens & Gilchrist PC

(57) ABSTRACT

A coin wrapper for wrapping coins comprises a coin input region for receiving the coins, a coin queuing mechanism for receiving the coins from the coin input region and moving each of the coins away from the coin input region, a coin stacking region for receiving coins from the coin queuing mechanism and stacking the coins on at least one stacking element to created a coin stack, and a coin wrapping region for receiving the coin stack on the stacking element from the coin stacking region. The coin wrapping region includes a plurality of rollers for rotating the coin stack and a paper feed mechanism for introducing paper to be wrapped around the coin stack.

34 Claims, 32 Drawing Sheets

U.S. PATENT DOCUMENTS

| | | | | |
|---|---|---|---|---|
| 3,938,303 | A | 2/1976 | Ushio et al. | |
| 3,950,921 | A | 4/1976 | Itoda et al. | 53/67 |
| 4,026,089 | A | 5/1977 | Murakami et al. | 53/77 |
| 4,040,434 | A | 8/1977 | Watanabe et al. | 133/1 A |
| 4,047,361 | A | 9/1977 | Ono et al. | 53/212 |
| 4,047,364 | A | 9/1977 | Murakami et al. | 53/389 |
| 4,049,011 | A | 9/1977 | Nakai et al. | 133/1 A |
| 4,052,839 | A | 10/1977 | Gross | 53/212 |
| 4,058,954 | A | 11/1977 | Asami | 53/54 |
| 4,058,955 | A | 11/1977 | Nakai et al. | 53/212 |
| 4,060,093 | A | 11/1977 | Douno | 133/1 A |
| 4,063,399 | A | 12/1977 | Nakai et al. | 53/59 R |
| 4,069,647 | A | 1/1978 | Horie | 53/212 |
| 4,085,879 | A | 4/1978 | Nobuhiro | 225/93 |
| 4,098,056 | A | 7/1978 | Ozaki | 53/212 |
| 4,102,110 | A | 7/1978 | Iizuka et al. | 53/59 A |
| 4,123,892 | A | 11/1978 | Asami | 53/54 |
| 4,126,146 | A | 11/1978 | Ozaki | 133/3 A |
| 4,128,102 | A | 12/1978 | Asami et al. | 133/1 A |
| 4,137,927 | A | 2/1979 | Matono | 133/1 A |
| 4,138,834 | A | 2/1979 | Nobuhiro | 53/212 |
| 4,159,607 | A | 7/1979 | Uchida et al. | 53/64 |
| 4,162,598 | A | 7/1979 | Watanabe et al. | 53/54 |
| 4,199,911 | A | 4/1980 | Miyazaki | 53/64 |
| 4,211,052 | A | 7/1980 | Miyazaki | 53/77 |
| 4,219,985 | A | 9/1980 | Uchida et al. | 53/212 |
| 4,220,169 | A | 9/1980 | Furuya | 133/8 A |
| 4,221,103 | A | 9/1980 | Uchida | 53/212 |
| 4,224,777 | A | 9/1980 | Miyazaki et al. | 53/641 |
| 4,224,778 | A | 9/1980 | Miyazaki et al. | 53/64 |
| 4,228,632 | A | 10/1980 | Watanabe | 53/54 |
| 4,232,690 | A | 11/1980 | Watanabe et al. | 133/8 R |
| 4,234,002 | A | 11/1980 | Uchida et al. | 133/1 A |
| 4,235,061 | A | 11/1980 | Watanabe et al. | 53/54 |
| 4,249,363 | A | 2/1981 | Miyazaki | 53/508 |
| 4,249,553 | A | 2/1981 | Sentoku | 133/1 A |
| 4,257,208 | A | 3/1981 | Uchida | 53/212 |
| 4,263,770 | A | 4/1981 | Furuya | 53/501 |
| 4,276,735 | A | 7/1981 | Miyazaki | 53/212 |
| 4,282,701 | A | 8/1981 | Miyazaki et al. | 53/465 |
| 4,307,556 | A | 12/1981 | Furuya | 53/54 |
| 4,333,296 | A | 6/1982 | Watanabe | 53/64 |
| 4,353,195 | A | 10/1982 | Nakamura | 53/54 |
| 4,362,176 | A | 12/1982 | Watanabe | 133/1 A |
| 4,363,032 | A | 12/1982 | Kimoto | 340/679 |
| 4,383,541 | A | 5/1983 | Uchida | 133/8 A |
| 4,384,644 | A | 5/1983 | Uchida | 106/0.8 |
| 4,392,504 | A | 7/1983 | Sentoku | 133/1 A |
| 4,400,928 | A | 8/1983 | Watanabe | 53/64 |
| 4,409,773 | A | 10/1983 | Bergman et al. | 53/54 |
| 4,409,776 | A | 10/1983 | Usui | 53/399 |
| 4,412,550 | A | 11/1983 | Watanabe et al. | 133/8 A |
| 4,435,992 | A | 3/1984 | Berthold | 74/89.15 |
| 4,457,321 | A | 7/1984 | Watanabe et al. | 133/8 A |
| 4,480,651 | A | 11/1984 | Nakai et al. | 133/3 A |
| 4,509,542 | A | 4/1985 | Watanabe et al. | 133/8 A |
| 4,515,172 | A | 5/1985 | Nakamura et al. | 133/8 A |
| 4,546,875 | A | 10/1985 | Zweber | 206/0.82 |
| 4,554,775 | A | 11/1985 | Asami et al. | 53/64 |
| 4,606,360 | A | 8/1986 | Mills | 133/1 A |
| 4,674,260 | A | 6/1987 | Rasmussen et al. | 53/212 |
| 4,677,811 | A | 7/1987 | Brisebarre | 53/456 |
| 4,717,044 | A | 1/1988 | Suzuki et al. | 221/130 |
| 4,718,218 | A | 1/1988 | Ristvedt | 53/532 |
| 4,729,211 | A | 3/1988 | Sakurai | 53/465 |
| 4,765,464 | A | 8/1988 | Ristvedt | 206/0.82 |
| 4,781,010 | A | 11/1988 | Furuya et al. | 53/64 |
| 4,820,237 | A | 4/1989 | Shinozaki et al. | 453/61 |
| 4,832,655 | A | 5/1989 | Sakurai | 453/61 |
| 4,835,938 | A | 6/1989 | Sakurai | 53/212 |
| 4,852,253 | A | 8/1989 | Uchida | 30/2 |
| 4,861,312 | A | 8/1989 | Sentoku | 453/7 |
| 4,869,029 | A | 9/1989 | Takatani et al. | 53/52 |
| 4,896,481 | A | 1/1990 | Sentoku et al. | 53/501 |
| 4,897,984 | A | 2/1990 | Sentoku et al. | 53/501 |
| 4,949,532 | A | 8/1990 | Fujimagari et al. | 53/542 |
| 4,950,203 | A | 8/1990 | Tomaiko | 453/59 |
| 4,951,448 | A | 8/1990 | Schmechel | 53/532 |
| 4,955,179 | A | 9/1990 | Kimura et al. | 53/212 |
| 4,979,357 | A | 12/1990 | Miyamoto | 53/504 |
| 4,992,075 | A | 2/1991 | Miyamoto | 453/61 |
| 4,996,822 | A | 3/1991 | Truppe | 53/213 |
| 4,997,406 | A | 3/1991 | Horiguchi et al. | 453/57 |
| 5,002,516 | A | 3/1991 | Watanabe et al. | 453/7 |
| 5,011,457 | A | 4/1991 | Takatani et al. | 453/61 |
| 5,022,890 | A | 6/1991 | Rapp | 453/56 |
| 5,086,607 | A | 2/1992 | Ozeki | 53/64 |
| 5,105,601 | A | 4/1992 | Horiguchi et al. | 53/465 |
| 5,129,205 | A | 7/1992 | Rasmussen | 53/52 |
| 5,142,847 | A | 9/1992 | Watanabe et al. | 53/532 |
| 5,155,978 | A | 10/1992 | Watanabe | 53/532 |
| 5,340,356 | A | 8/1994 | Cole | 453/59 |
| 5,360,370 | A | 11/1994 | Woolrich | 453/59 |
| 5,389,034 | A | 2/1995 | Rumbach | 453/61 |
| 5,435,113 | A | 7/1995 | Oikawa | 53/212 |
| 5,435,777 | A | 7/1995 | Takatani et al. | 453/31 |
| 5,441,448 | A | 8/1995 | Yang | 453/60 |
| 5,457,931 | A | 10/1995 | Kurata et al. | 53/212 |
| 5,487,252 | A | 1/1996 | Ozeki et al. | 53/212 |
| 5,499,483 | A | 3/1996 | Oikawa | 53/53 |
| 5,512,016 | A | 4/1996 | Tani | 453/32 |
| 5,513,481 | A | 5/1996 | Ozeki et al. | 53/532 |
| 5,520,577 | A | 5/1996 | Rasmussen | 453/56 |
| 5,525,104 | A | 6/1996 | Adams et al. | 453/10 |
| 5,540,031 | A | 7/1996 | Ozeki et al. | 53/212 |
| 5,551,911 | A | 9/1996 | Rumbach | 453/3 |
| 5,557,908 | A | 9/1996 | Ozeki et al. | 53/212 |
| 5,573,457 | A | 11/1996 | Watts et al. | 453/31 |
| 5,579,887 | A | 12/1996 | Leibu et al. | 194/317 |
| 5,595,338 | A | 1/1997 | Abler | 229/87.2 |
| 5,743,372 | A | 4/1998 | Furuya | 194/318 |
| 5,940,623 | A | 8/1999 | Watts et al. | 395/712 |
| 6,209,294 | B1 | 4/2001 | Hibari | 53/493 |
| 6,350,192 | B1 | 2/2002 | Kibihara | |
| 6,385,944 | B1 | 5/2002 | Taniguchi et al. | |

FOREIGN PATENT DOCUMENTS

| | | | | |
|---|---|---|---|---|
| EP | 423 798 B2 | | 4/1991 | A61C/8/00 |
| EP | 432 675 A2 | | 6/1991 | G07D/9/06 |
| EP | 546 772 B1 | | 6/1993 | G07D/9/06 |
| EP | 612 044 B1 | | 8/1994 | G07D/9/06 |
| EP | 615 216 A2 | | 9/1994 | G07D/9/06 |
| EP | 620 540 B1 | | 10/1994 | G07D/9/06 |
| EP | 702 337 A1 | | 3/1996 | G07D/3/12 |
| EP | 755 030 A2 | | 1/1997 | G07D/5/08 |
| EP | 849 712 A1 | | 6/1998 | G07D/9/06 |
| EP | 0 615 216 A2 | | 11/1998 | |
| EP | 893 789 A1 | | 1/1999 | G07D/1/12 |
| EP | 1 043 701 A1 | | 10/2000 | G07D/9/06 |
| GB | 1 565 119 | | 4/1980 | G07D/3/04 |
| GB | 2 076 373 | | 5/1980 | B65H/31/10 |
| JP | 54-31382 | | 3/1979 | B65B/11/56 |
| JP | 10-230905 | * | 9/1998 | 53/212 |
| JP | 11-53598 | | 2/1999 | G07D/3/00 |
| SU | 1408445 | | 7/1988 | |
| WO | WO 91/08952 | | 6/1991 | B65B/11/04 |
| WO | WO 97/43739 | | 11/1997 | G07D/3/04 |
| WO | WO 97/45811 | | 12/1997 | G07D/1/00 |
| WO | WO 98/08197 | | 2/1998 | G07D/9/00 |
| WO | WO 99/30287 | | 6/1999 | G07D/9/06 |
| WO | 02/05221 A2 | | 7/2001 | |

* cited by examiner

COIN WRAPPER

FIELD OF THE INVENTION

The present invention relates generally to coin processing devices and, more particularly to a coin wrapper.

BACKGROUND OF THE INVENTION

Coin wrapping machines have been used for a number of years. Wrapping coins facilities the handling and processing of large volumes of coins. Banks, casinos, retail stores, and money handling companies such as armored carriers are some of the beneficiaries of these machines. As business grows, these businesses are experiencing a greater number of customers resulting in an increased intake of coins. As would be expected, theses businesses desire to stack and wrap their coins as quickly and as accurately as possible.

Single coin denominations are stacked in a manner such that each coin stack of that particular denomination has a uniform value. For example, United States nickels are traditionally wrapped in stacks valuing two dollars and quarters are wrapped in stacks valuing ten dollars. The paper in which coins are wrapped is typically preprinted displaying the denomination and the value of the stack of wrapped coins. Coin wrappers have relieved those who deal with large quantities of coins from the burden of manually stacking and wrapping coins. Coin wrappers are also used to wrap other items such as, for example, casino tokens and subway tokens.

Coin wrapper typically operate by forming a coin stack in a stacking region, transferring the coin stack from the stacking region to a wrapping region, and then wrapping paper around the coin stack. Unfortunately, these machines are only capable of processing a coin stack, one stack at a time, which translates into an increased period of time to wrap a given batch of coins. Conventional coin wrappers also typically operate at the same speed regardless of the coin denomination to be wrapped. For example, it takes a longer period of time to produce a stack of wrapped quarters than it does for a stack of dimes. This time differential is due to the fact that a quarter has larger diameter than a dime. Accordingly, it take more time to create a coin stack when introducing axially aligned coins to the stacking region. It also takes more time to wrap paper around a coin stack having a larger diameter because there is a greater amount of surface area to cover.

Another feature of many coin wrapper is the crimping of the paper wrapped around the coin stack located at the top and the bottom of the coin stack. However, many coin wrapper simply smash the paper into the ends of the coins stack. This "smashing" does not always effectively bind the paper to prevent the paper from unraveling from around the coin stack. If the paper becomes unraveled the integrity of the wrap is destroyed and the coins can be spilled.

A problem with many conventional coin wrappers is the inability to accommodate coins having a wide range of diameters. The smallest coin available internationally, currently known to applicants, is the Holland dime which has a diameter of approximately 0.59 inches (approximately 1.50 cm). The largest coin/token available is the five dollar casino token which has diameter of approximately 1.76 inches (approximately 4.47 cm). Many conventional coin wrappers are unable to accommodate coins ranging in diameter size between 0.59 to 2 inches. Other coin wrappers are only able to accommodate a few specific diameters within this range. For example, a conventional coin wrapper may be able to process several coins having markedly different diameters, but because the moveable parts of the coin wrapper are cam driven, the coin wrapper is unable to accommodate any coin having diameters falling between specific diameters. Put another way, the cam is only able to move the coin wrapper components to specific positions rather than to any positions within the corresponding range of coin diameters which the coin wrapper can accommodate. Accordingly, what is needed is a coin wrapper which can quickly and effectively wrap coins and/or tokens of a variety of denominations and/or sizes.

SUMMARY OF THE INVENTION

According to one embodiment of the present invention, there is provided a coin wrapping device for receiving a batch of coins and then quickly and accurately stacking and wrapping the coins. In accordance with the present invention, a coin wrapper which comprises a coin input region for receiving coins, a coin queuing mechanism for receiving the coins from the coin input region and moving each of the coins away from said coin input region, a first and a second coin shuttle, a coin stacking region for receiving the coins from the coin queuing mechanism and for stacking the coins on the first or second coin shuttle, and a coin wrapping region for receiving the coin stack on the first or second coin shuttle from the coin stacking region. The coin wrapping region includes a plurality of rollers for rotating the coin stack and a paper feed mechanism for introducing paper to be wrapped around the coin stack. The coin wrapper further comprises a first arm coupled to the first shuttle which is adapted to move the first shuttle in the horizontal and vertical directions and a second arm coupled to the second shuttle which is adapted to move the second shuttle in the horizontal and vertical directions. The first and second arms are adapted to reciprocally move the first and second coin shuttles, respectively, between the stacking and the wrapping regions. Thus, each of the first and second coin shuttle independently receive a coin stack and subsequently move the coin stack from the stacking region to the wrapping region to be wrapped.

Another aspect of the present invention is directed to the use of a plurality of motors which are directly coupled to the various moveable operational and set-up components of the coin wrapper. For example, at least one motor is directly coupled to each of the first and second arms to provide the horizontal and vertical movement to the first and second arms during the operation of the coin wrapper. Direct drive motors also move many of the structural components of the coin wrapper into set-up positions corresponding to a plurality of coin denominations to be wrapped. For example, in one embodiment of the present invention, a motor directly coupled to the plurality of rollers moves the plurality of rollers between a plurality of set-up positions corresponding to the plurality of coin denominations to be wrapped.

According to some embodiments of the present invention, the first and the second shuttles are variable sized shuttle wherein each of the shuttles has two stacking elements each having a different diameter. Essentially, one stacking element is a large coin stacking element and the other is a small coin stacking element. The large coin stacking element is used in conjunction with the wrapping of larger coins. The smaller coin stacking element is to be used in conjunction with the wrapping of the smaller coins.

According to some embodiments of the present invention, the wrapping region contains at least two tucker guides which are disposed adjacent to the plurality of rollers. The two tucker guides are adapted to direct the paper around the stack of coins. Other embodiments of the present invention include a piece of a fiberglass sheet having a curved shaped disposed adjacent to one of the plurality of rollers. The sheet is adapted to guide the paper from one of the plurality of rollers to another one of the plurality of rollers.

According to some embodiments of the present invention, the wrapping region includes an upper and a lower crimp arm which are adapted to crimp the paper wrapped around the coin stack at the upper and lower ends of the coin stack to create a paper toroid at the upper and lower ends of the coin stack. The upper and lower crimp arms are movable in a direction parallel to an axis of the coin stack and in a radial direction with respect to the axis of the coin stack. In another alternative embodiment, the coin wrapper also includes at least one motor directly coupled to the upper and lower crimp arms. One motor is adapted to move the upper and lower crimp arms in a direction parallel to an axis of the coin stack and in a radial direction with respect to the axis of the coin stack.

According to some embodiments of the present invention, the plurality of rollers in the wrapping region are adapted to rotate the coin stack at a plurality of speeds corresponding to a plurality of coin denominations to be wrapped. The coin wrapper includes at least one motor directly coupled to the plurality of rollers to provide rotational movement to each of the plurality of rollers at the plurality of speeds.

According to some embodiments of the present invention, the paper feed mechanism comprises a pair of paper feed rollers. A pre-feed roller draws paper off of a roll of paper. A primary paper feed roller is adapted to introduce paper to the coin stack at one of a plurality of speeds corresponding to a plurality of coin denominations to be wrapped. The paper is introduced to the coin stack at a speed slightly faster than the speed at which the paper circumferentially moves around the coin stack.

According to some embodiments of the present invention, the input region includes a coin table moveable between a plurality of set-up positions corresponding to a plurality of coin denominations to be wrapped. The coin queuing mechanism includes side walls defining a coin passage that is generally tangential to the coin table. At least one of the side walls is moveable between a plurality of coin passage set-up positions corresponding to a plurality of denominations to be wrapped. At least one motor is directly coupled to said plurality of guide walls for moving the coin table and one of the guide walls among the plurality of set-up positions.

The above summary of the present invention is not intended to represent each embodiment, or every aspect, of the present invention. Additional features and benefits of the present invention will become apparent from the detail description, figures, and claim set forth below.

BRIEF DESCRIPTION OF THE DRAWINGS

Other objects and advantages of the invention will become apparent upon reading the following detailed description and upon reference to the drawings in which.

DETAILED DESCRIPTION OF THE PREFERRED EMBODIMENTS

A coin wrapper 100 according to one embodiment of the present invention is illustrated in FIGS. 1–4. The coin wrapper 100 is capable of wrapping coins spanning a wide rage of sizes. In one embodiment of the present invention, the coin wrapper 100 is able to wrap coins having diameters ranging from that of the Holland dime (0.59 inch) through that of the five dollar casino token (1.76 inches). The coin wrapper 100 is able to accommodate any coin diameter falling within that range rather than only a few selected sizes within that range.

Figure 7:
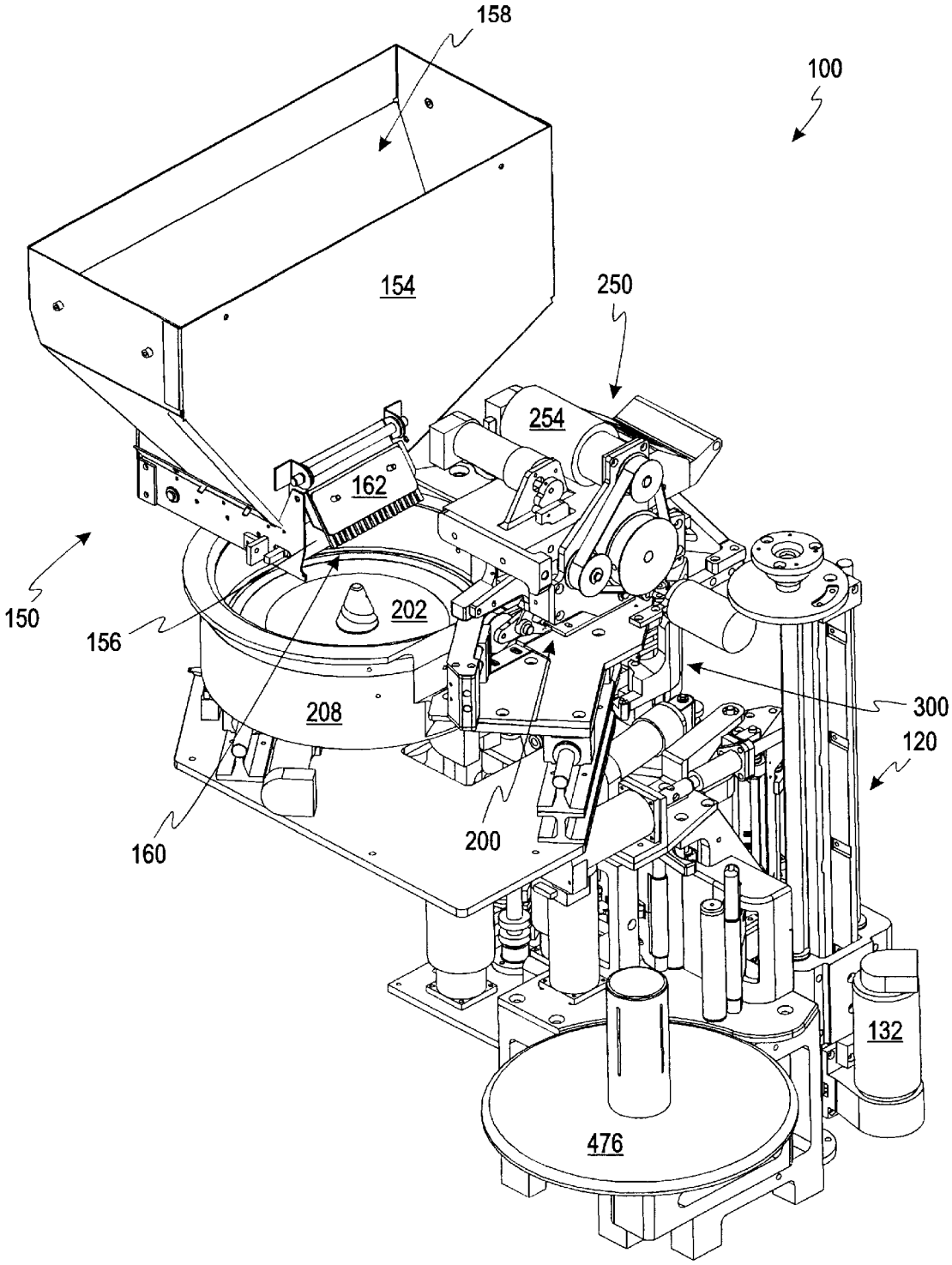
FIG. 7 is a rear perspective view of a coin wrapper according to one embodiment of the present invention.
Figure 8:
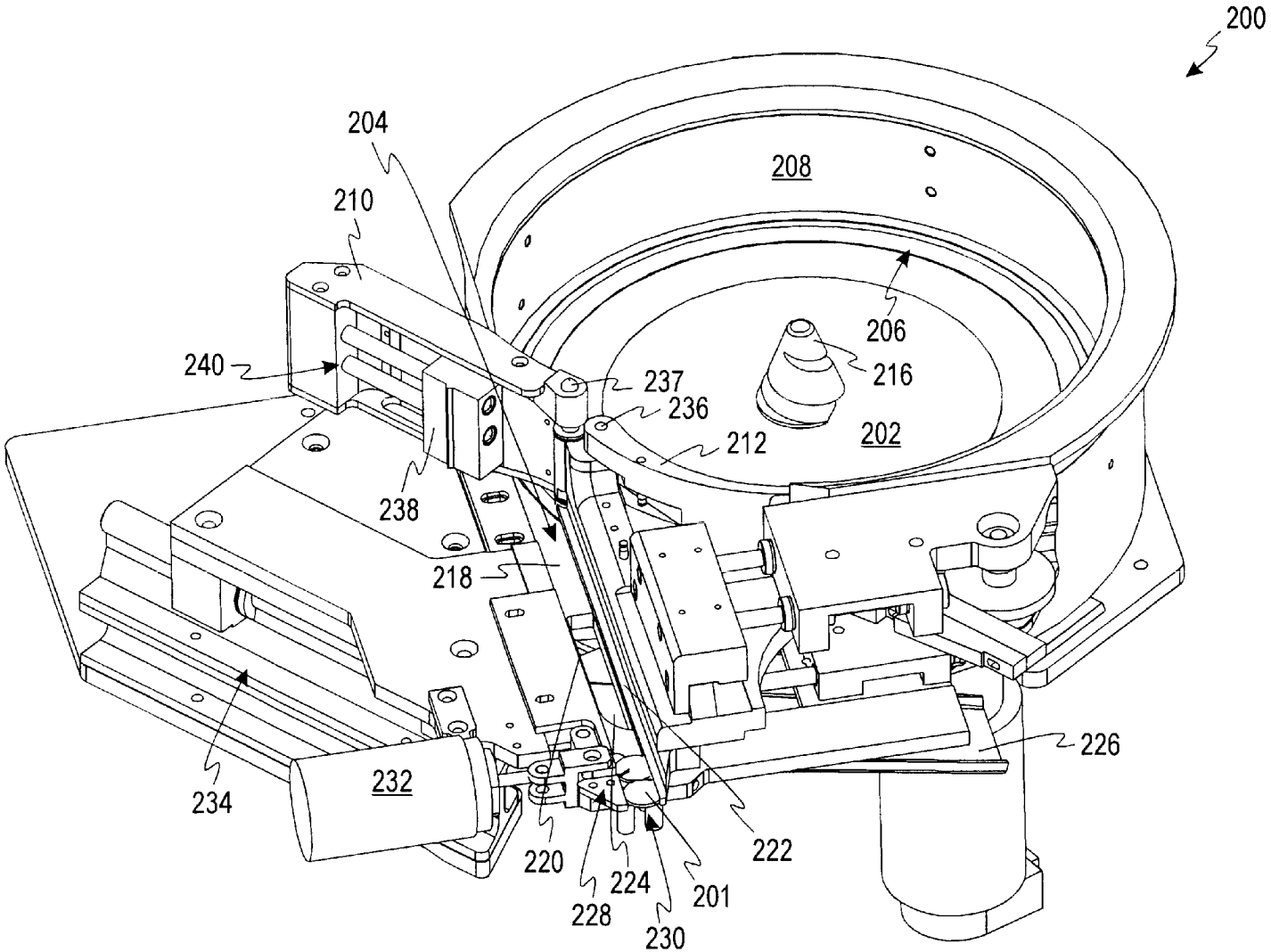
FIG. 8 is a perspective view of a queuing mechanism for a coin wrapper spatially adjusted to accommodate a coin/token denomination having a small diameter according to one embodiment of the present invention.

In operation, coins to be wrapped are fed into the coin wrapper 100 via a coin input region 150 (shown in detail in FIG. 8). Coins are directed, one at a time, from the input region 150 by a queuing mechanism 200 (shown in detail in FIG. 7) to a stacking region 300 (shown in detail in FIGS. 14 and 15). In the stacking region 300 a predetermined number of coins are stacked upon a coin stacking element so that the centers of the coins are axially aligned to form a coin stack 101. The coin stack 101 is then transferred on the coin stacking element to a wrapping region 400. In the wrapping regions, the coin stack is rotated and paper is wrapped around the coin stack 101. After the paper at the ends of the coin stack is crimped thus fixing the paper around the coins stack 101, the wrapped coin stacked is delivered downwardly from the coin wrapping region 400.

The coin wrapper 100 may be controlled from a control unit which has a display/user-interface, which may incorporate a graphical user interface in one embodiment of the present invention, which displays information, including "functional keys" when appropriate. Alternatively, additional physical keys or buttons, such as a keyboard may be employed. In one embodiment of the present invention, the coin wrapper 100 is preprogrammed to operate in one of a plurality of operational modes corresponding to a plurality of coin denominations. For example, United States quarters have a known diameter and are traditionally wrapped in stacks of forty quarters having a aggregate value of ten dollars. A user would input to the coin wrapper 100 via the display/user-interface that the U.S quarter is the coin denomination to be wrapped. A "functional key" on a graphical user interface may be employed for this purpose. Pursuant to a preprogrammed mode of operation, the controller would then prepare the coin wrapper 100 for wrapping quarters by making several spatial adjustments to move the various structural components of the coin wrapper 100 to "set-up" positions. Further, the speed at which the coin wrapper 100 operates is also dependent on the denomination of the coin to be wrapped and the operational speed is established.

The coin wrapper 100 contains two stacking elements or coin shuttles, the first (left-side) coin shuttle 102 and the second (right-side) coin shuttle 104. Inside the stacking region 300, coins are stacked upon one coin shuttle 102, 104 to create a coin stack 101. In the embodiment illustrated in FIG. 1, the second coin shuttle 104 is shown in the stacking region 300. The two coin shuttles 102, 104 reciprocally move between the stacking region 300 and the wrapping region 400. In operation, once a predetermined number of coins are stacked upon the second coin shuttle 104, the second coin shuttle 104 descends into the wrapping region 400 where the wrapping process commences. While the second coin shuttle 104 and the coin stack thereon is exiting from the stacking region 300, the first coin shuttle 102 (shown in the lowermost position) travels vertically to a predetermined height and then moves horizontally into the stacking region 300. Once the wrapping of the coin stack on the second coin shuttle 104 is complete, the second coin shuttle vertically descends out of the wrapping region 400, horizontally moves away from the wrapping region 400, and then vertically ascends towards the stacking region 300. The two coin shuttles 102, 104 reciprocally move between the stacking region 300 and the wrapping region 400 in this manner until the wrapping of the batch of coins is complete.

The first coin shuttle 102 is attached to a first arm 112. The second coin 104 shuttle is attached to a second arm 114. The first and second arms 112, 114 provide movement to the first and second coin shuttles 102, 104, respectively.

Figure 5:
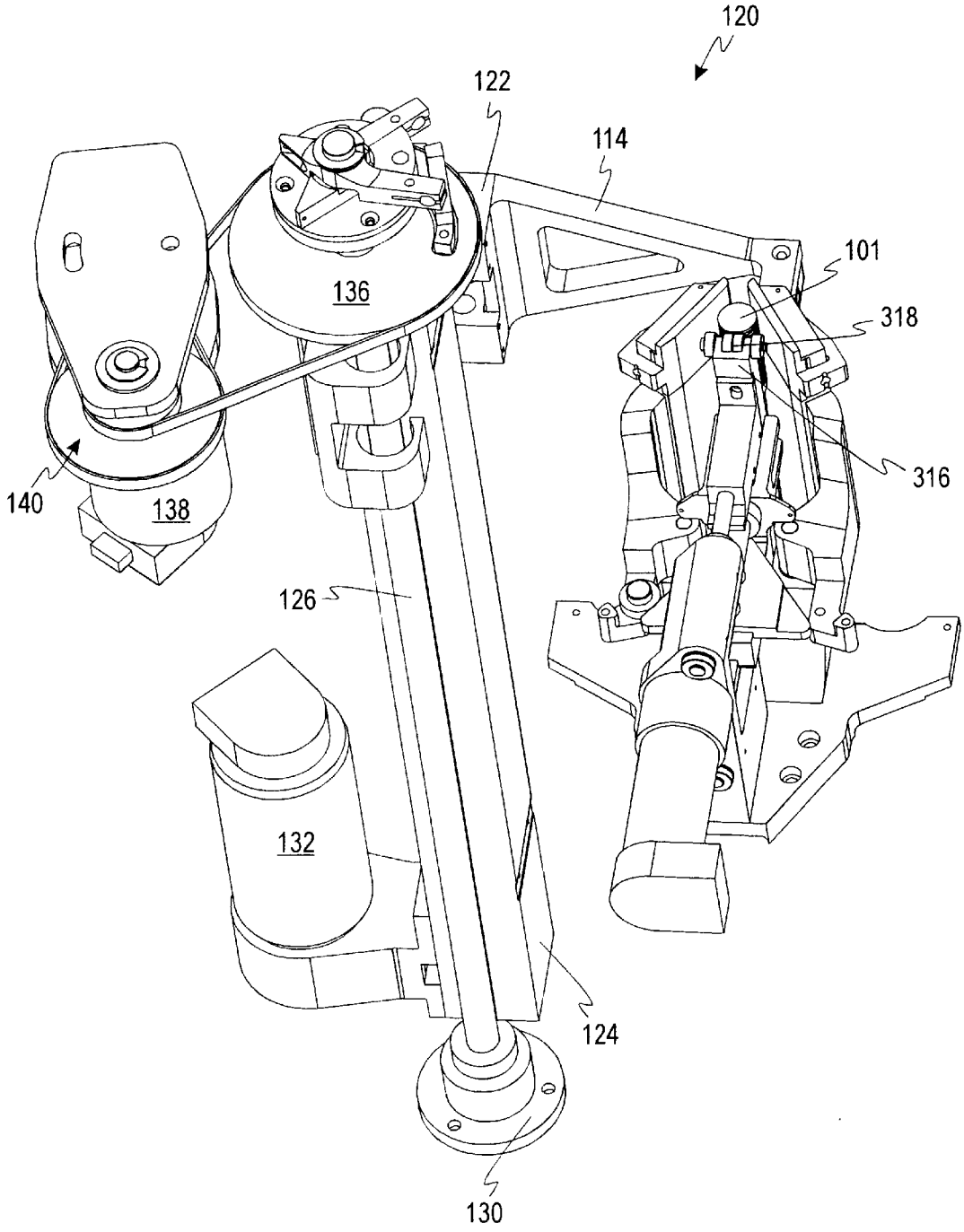
FIG. 5 is a rear perspective view of an arm drive structure for a coin wrapper according to one embodiment of the present invention.
Figure 6:
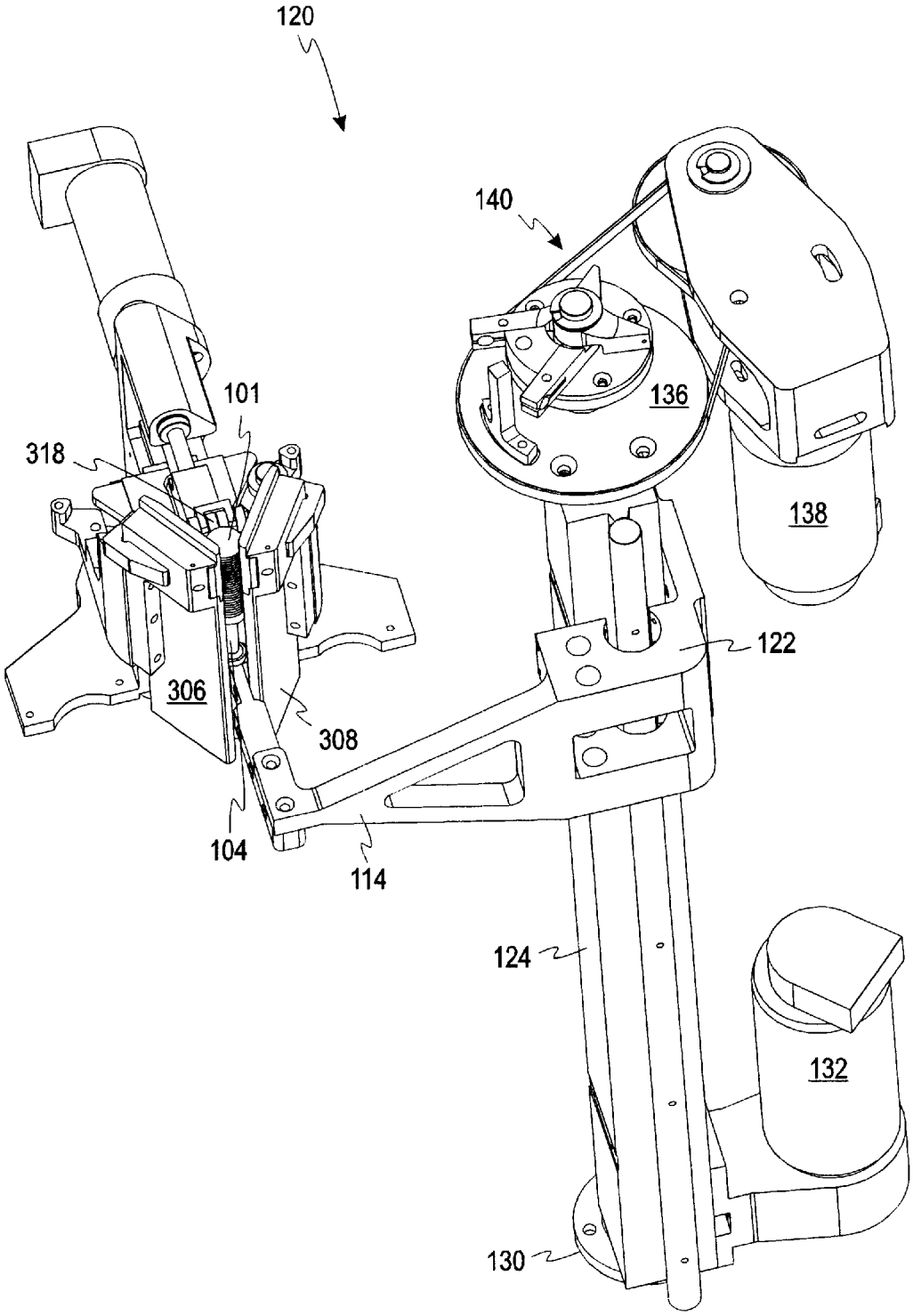
FIG. 6 is a front perspective view of an arm drive structure for a coin wrapper according to one embodiment of the present invention.

Referring to FIGS. 5 and 6, an arm drive structure 120 of the coin wrapper 100 is shown. While only the second arm 114 is illustrated in FIGS. 5 and 6, movement is provided to both of the arms 112, 114 in essentially the same manner. The second arm 114 is shown positioning the coin shuttle 104 within the stacking region 300 while receiving coins to form a coin stack 101. The arm 114 includes a base 122 which is slidably engaged to a vertical support member 124. The arm 114 travels in the vertical direction along the vertical support member 124. Movement is imparted to the arm 114 by an externally threaded rod 126 which is threaded through an internally threaded aperture 128 extending through the base 122 of the arm 114. The lower end of the threaded rod 126 is rotatably coupled to a base 130.

Rotation is provided to the threaded rod 126 by a first motor 132. The first motor 132 is coupled to the threaded rod 126 via a belt (not shown) within a housing 134. The rotation of the of the threaded rod 126 which is transferred from the first motor 132 via the belt causes the external threads of the threaded rod 126 to engage the internal threads within the base 122 of the arm 114 to provide vertical movement to the arm 114. Clockwise rotation of the threaded rod 126 causes the arm 114 to ascend while counterclockwise rotation causes the arm 114 to descend.

Horizontal movement is imparted to the arm 114 by a pulley 136 which is fixedly attached to the vertical support member 124. The entire arm drive mechanism 120 illustrated in FIGS. 5 and 6 is pivotally attached to a structure (not shown). Accordingly, the movement of the pulley 136 will cause the structure 120 to rotate about the structure to which it is pivotally attached and, thus, provides horizontal movement to the arm 114 and the coin shuttle 104. A second motor 138 is coupled to the pulley 136 via series of belts and pulleys 140 to provide the rotational movement to the pulley 136.

Referring now to FIG. 7, the input region 150 will be described in greater detail. A batch of coins to be wrapped is input to the coin wrapper 100 via a coin hopper 154. The coin hopper 154 is disposed above a wide conveyor belt 156. The wide conveyor belt 156 moves the coins to the coin queuing mechanism 200. The coin hopper 156 contains an upper opening 158 and a lower opening 160. The coin hopper 154 and the wide conveyor belt 156 are situated such then the lower opening 110 of the coin hopper 154 is disposed substantially directly above the wide conveyor belt 156 so that a batch of coins placed into the coin hopper 154 physically rests on the conveyor belt 106. In this regard, the wide conveyor belt 156 essentially acts as a floor of the coin hopper 154. The upper opening 158 of the coin hopper 154 is large to facilitate the "dumping" of a batch of coins into the coin hopper 154. The coin hopper 154 is converging or "funnel shaped" to directed coins dumped into the upper opening 158 onto the wide conveyor belt 156.

In the operation of the coin wrapper 100, the conveyor belt 156 moves the coins from the input region 152 to the coin queuing mechanism 200. Movement is provided to the wide conveyor belt via a motor (not shown). In the embodiment illustrated in FIG. A, the coin hopper 154 contains a gate 162 which is pivotally mounted to the coin hopper 154. The gate 162 is biased in the closed position and prevents the spilling of coins out of the input region 152. The gate 162 also limits the number of coins which are transferred out of the input region 150. A limited, steady flow of coins from the coin input region 102 to the coin queuing mechanism 200 is preferred.

Disposed below the input region 150 is the queuing mechanism 200. The queuing mechanism 200 receives coins from the input region 102 and then transfers the coins to the stacking region 300, one coin at a time, by axially aligning the coins in a single row.

Figure 9:
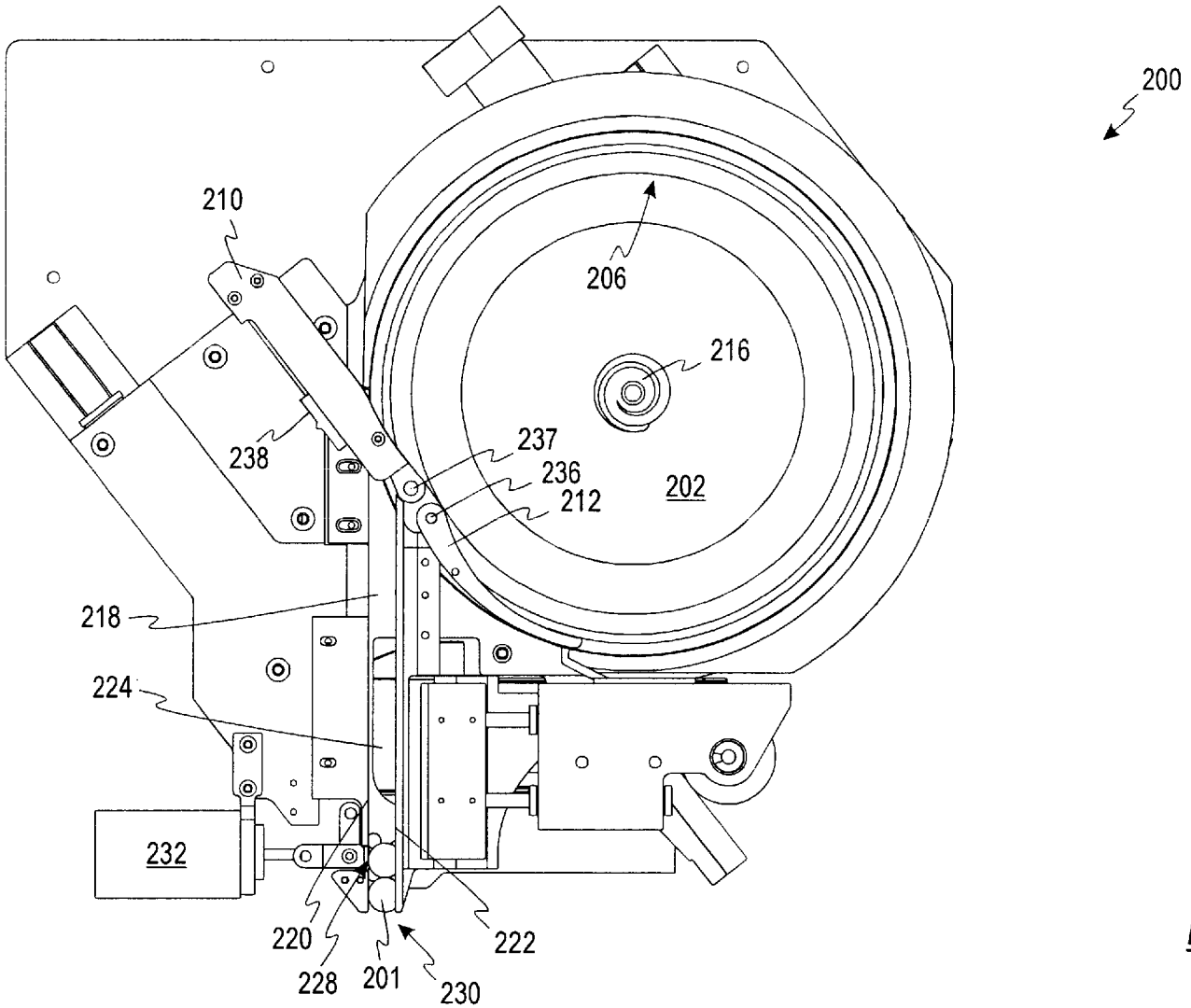
FIG. 9 is a top view of a queuing mechanism for a coin wrapper spatially adjusted to accommodate a coin/token denomination having a small diameter according to one embodiment of the present invention.
Figure 10:
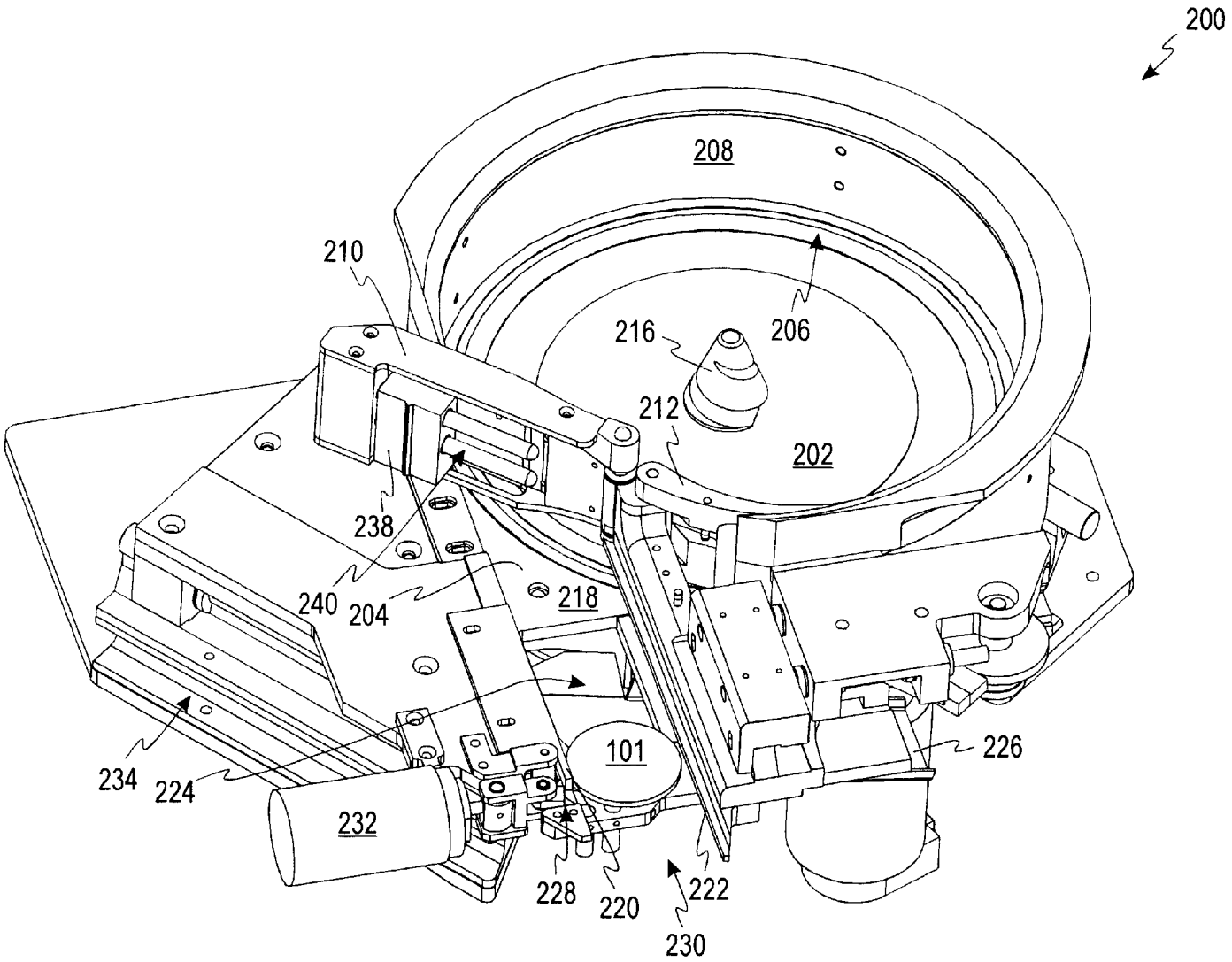
FIG. 10 is a perspective view of a queuing mechanism for a coin wrapper spatially adjusted to accommodate a coin/token denomination having a large diameter according to one embodiment of the present invention.
Figure 11:
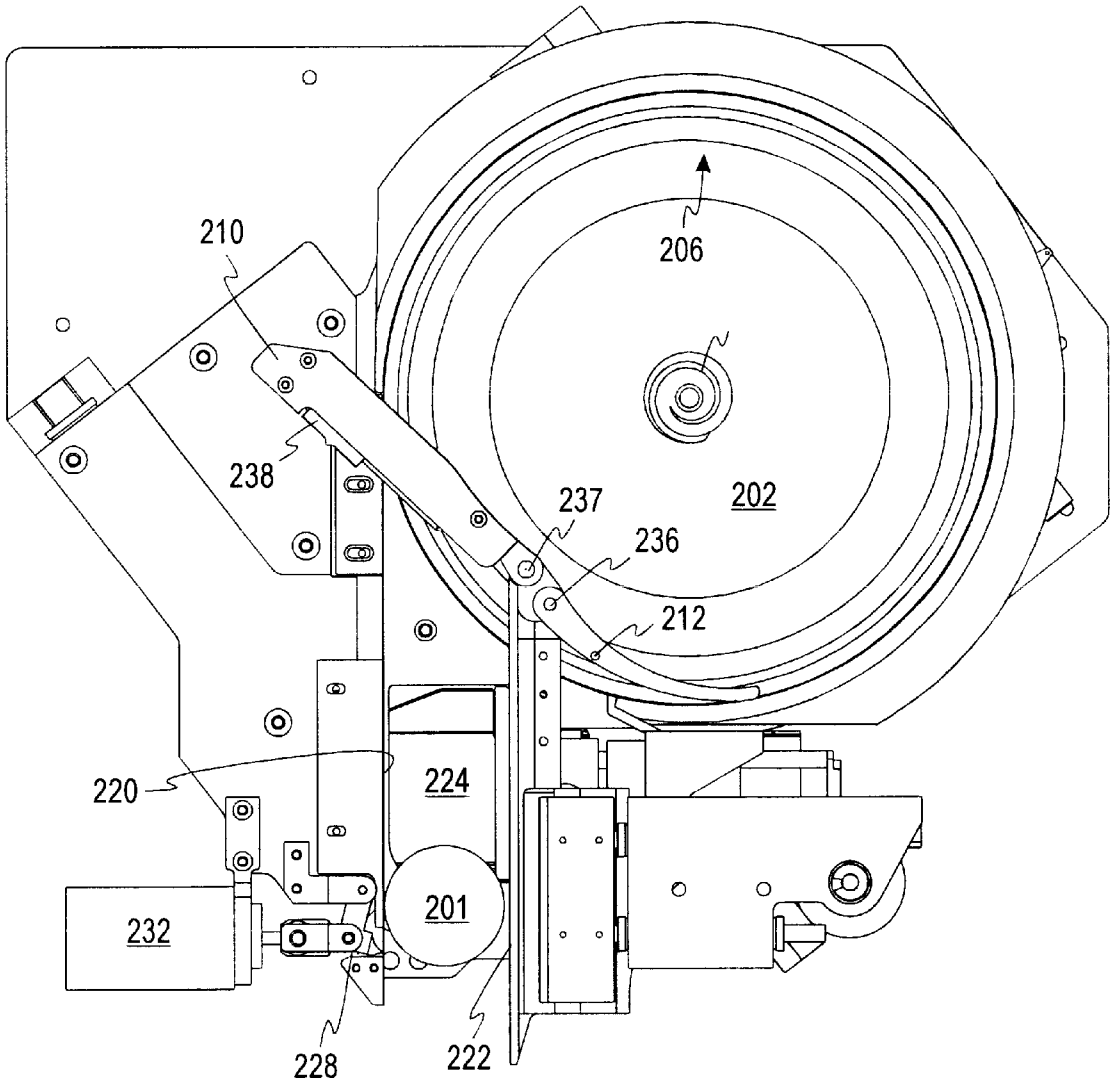
FIG. 11 is a top view of a queuing mechanism of a coin wrapper spatially adjusted to accommodate a coin/token denomination having a large diameter according to one embodiment of the present invention.

Referring now to FIGS. 8–11, the queuing mechanism 200 of the coin wrapper 100 illustrated in FIGS. 8 and 9 is spatially adjusted to accommodate a coin/token 201 denomination having a smaller diameter (e.g. a Holland dime), while the queuing mechanism 200 illustrated in FIGS. 10 and 11 is spatially adjusted to accommodate a coin/token denomination 201 having a lager diameter (e.g. a five dollar casino token). The queuing mechanism includes a coin table 202 and a coin track 204. The coin track 204 is positioned generally tangential to the coin table 202. Coins which are to be delivered to the stacking region 300 by the queuing mechanism 200 are first deposited on the coin table 202 by the wide conveyor belt 106. The coin table 202 rotates in the counter-clockwise direction thus imparting a centrifugal force to the coins 101 causing the coins to move to the periphery 206 of the coin table 202. A wall 208, a coin block 210, and a curved follower 212 are positioned at the periphery 206 of the coin table 202. As the coins slide radially outward on the coin table 202, the wall 208 and the curved follower 212 engage the edges of the coins and prevents any further radial movement of the coins. The coins then travel in the counter-clockwise direction around the coin table 202 while pressing against the wall 208. The coin block contains a slot 214 disposed therein which allows a single coin traveling along the wall 208 of the coin table 202 to enter the coin track 204. The illustrated embodiment of the coin table 202 includes a coin agitator 216 which distributes the coins onto the coin table 202 as the coins are delivered to the coin table 202 by the wide conveyor belt 106. The agitator separates any coins which are grouped together towards the center of the coin table 202.

The coin track 204 contains a drive belt 252 (shown in FIGS. 12 and 13) to transfer the coins to the stacking region 300. The belt 252 engages the top surface of the coins so that the coins 201 slide along a floor 218 of the coin track 204. The coins 201 are transported in single file fashion to the stacking region 300. The coin track 204 has a first side wall 220 and a second side wall 222 to maintain the axial alignment of the coins along the coin track 204. The floor 218 of the coin track 204 contains an offsort aperture 224 through which smaller coin denominations inadvertently mixed in with the batch of coins to be wrapped pass through and are guided by an offsort ramp 226 to an offsort area (not shown).

In operation, the coin track 204 delivers a predetermined number of coins 201 to the stacking region 300. The coin track 204 contains a stop pawl 228 located at a terminal end 230 of the coin track 204. The stop pawl 228 interrupts the flow of further coins 201 to the stacking area 300 once the predetermined number of coins 201 have been delivered to the stacking region 300. The stop pawl 228 retracts when the stacking region 200 is ready to receive more coins. The stop pawl 228 is coupled to a solenoid 232 which extends and retracts the stop pawl 228.

The coin table 202 and the coin track 204 are designed to deliver the center of the coins to be wrapped to substantially the same point in the stacking region 300 regardless of coin denomination size. Accordingly, the coin table 202 and coin track 204 are both moveable to a plurality of positions corresponding to a plurality of coin denominations to be wrapped. The first side wall 220 of the coin track 204 is slidably engaged along a rail 234. A motor (not shown) is attached to the first side wall to provide movement to the first side wall 220. The coin table 202 and the coin table wall 208 are coupled to the first side wall 220 and move along with the first side wall 220. The second side wall 222 of the coin track 204 is slidably engaged to a rail (not shown). The curved follower 212 and the coin block 210 are pivotally attached to the second side wall 222. A first pin 236 couples the curved follower 212 to the second side wall while a second pin 237 couples the coin block to the second side wall 222. The coin block 210 is also coupled to the first side wall 220 via a pivot member 238 with which it is slidably engaged. The coin block 210 contains integral rails 240 which are coupled to the pivot member 238. The pivot member 238 is pivotally attached to the first side wall 220. A motor (not shown) provides movement to the second side wall 222 and in turn to the coin block 210 and the coin follower 212.

In operation, the coin track 204 widens or narrows to accommodate the particular denomination of the coin to be wrapped. Referring to FIG. 11, for example, the track 204 is widened to accommodate a five dollar casino token. The first side wall 220 moves back and to the left. The second side wall 220 slides to the right. The coin block 210 and the curved follower are moved to the right along with the second side wall 222. The curved follower 212 is spring loaded and biased radially outward with respect to the coin table 202 which causes the follower 212 to press against the coin table wall 208. As the second side wall 222 pulls the coin block 210 to the right, the coin block 210 is pivoting about pin 237 and sliding along integral rails 240 which are slidably engaged to the pivot member 238 which in turn is pivoting about the first side wall 200 about the pin 237. Meanwhile, the first side wall 220 moves back and to the left thus moving the coin table 202 and the wall 208 with which the first side wall 220 is engaged. The coin table 202 and the wall 208 move so that the first side of wall 202 is always substantially tangential to the coin table 202. It is preferable to maintain the first side wall 202 tangential to the coin table 202 because the centrifugal force of the coin table 202 sends the coins on the coin table 202 the periphery 206 of the coin table. Accordingly, positioning the coin track 204 tangential to the coin table 202 maximizes the speed at which coins on the coin table 202 enter the coin track 204.

Figure 1:
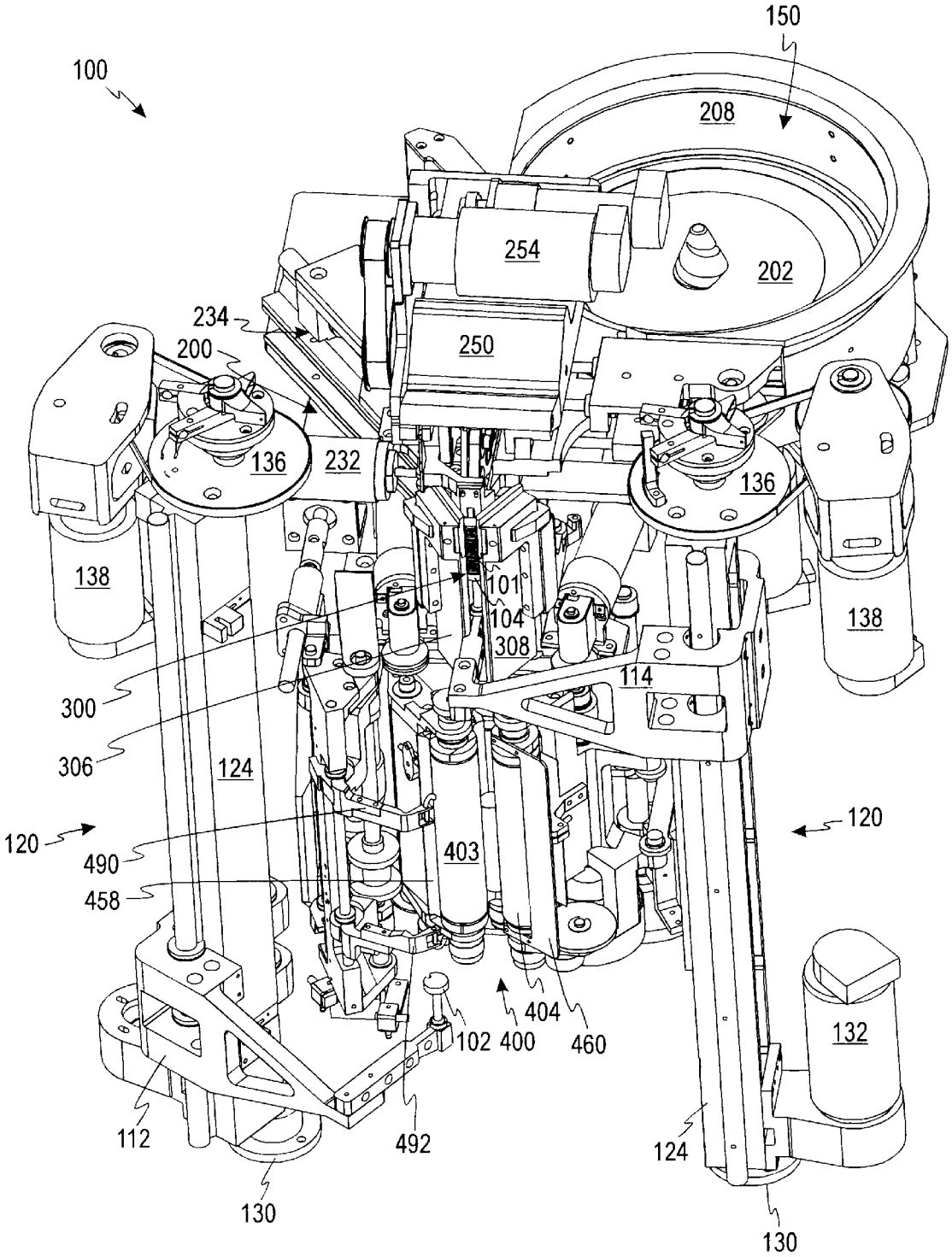
FIG. 1 is a front perspective view of a coin wrapper according to one embodiment of the present invention.
Figure 2:
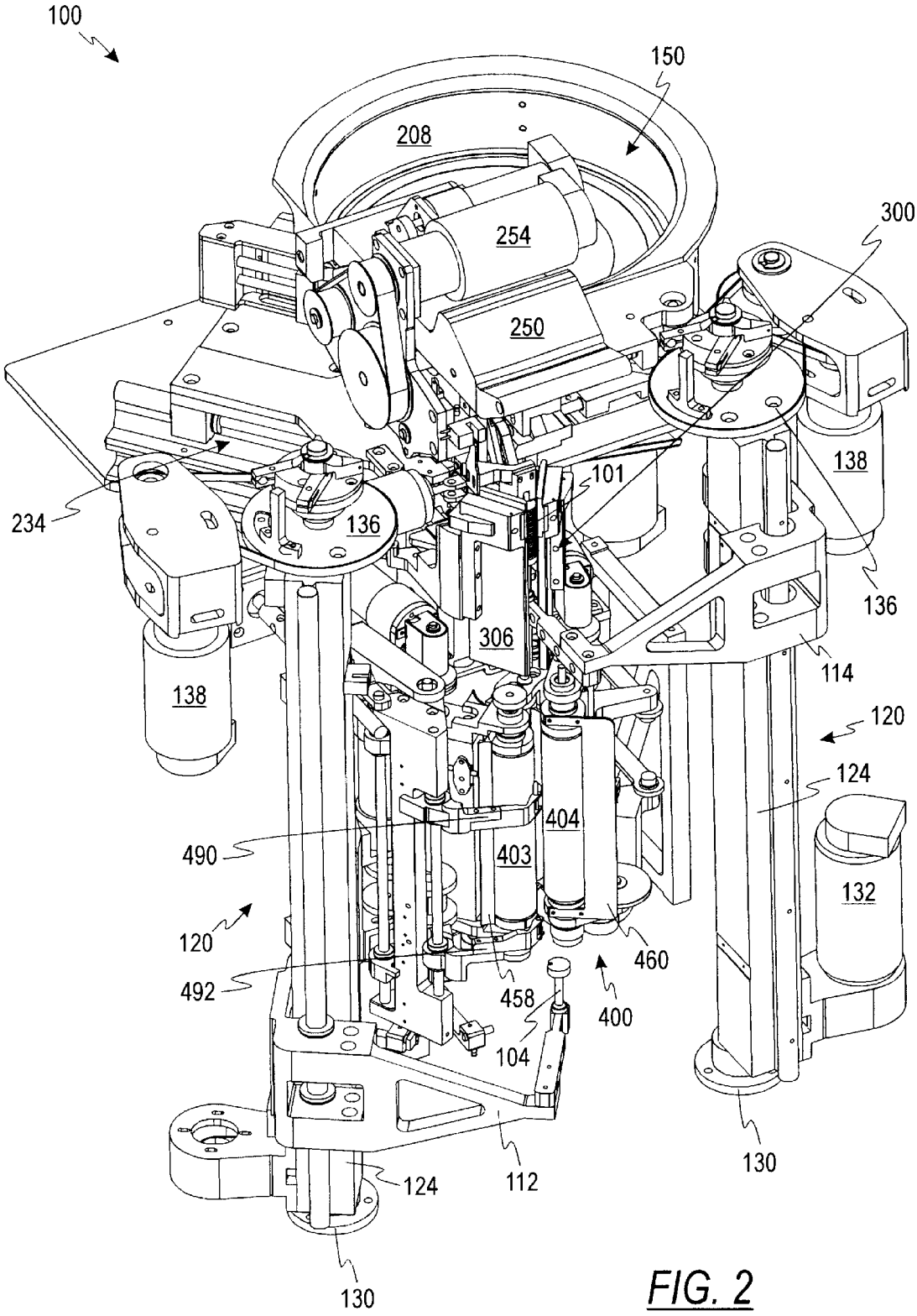
FIG. 2 is a left-side perspective view of a coin wrapper according to one embodiment of the present invention.
Figure 3:
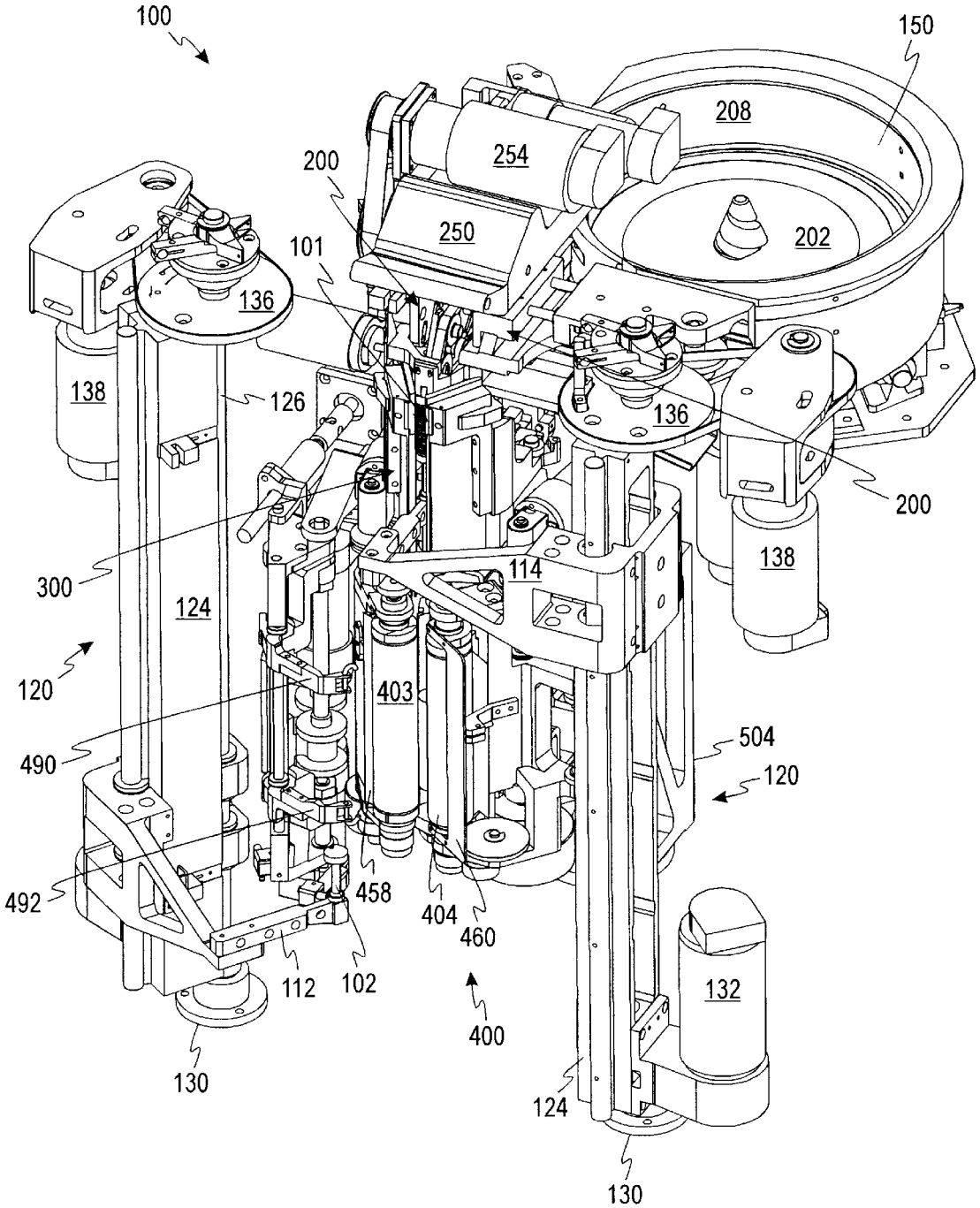
FIG. 3 is a right-side perspective view of a coin wrapper according to one embodiment of the present invention.
Figure 4:
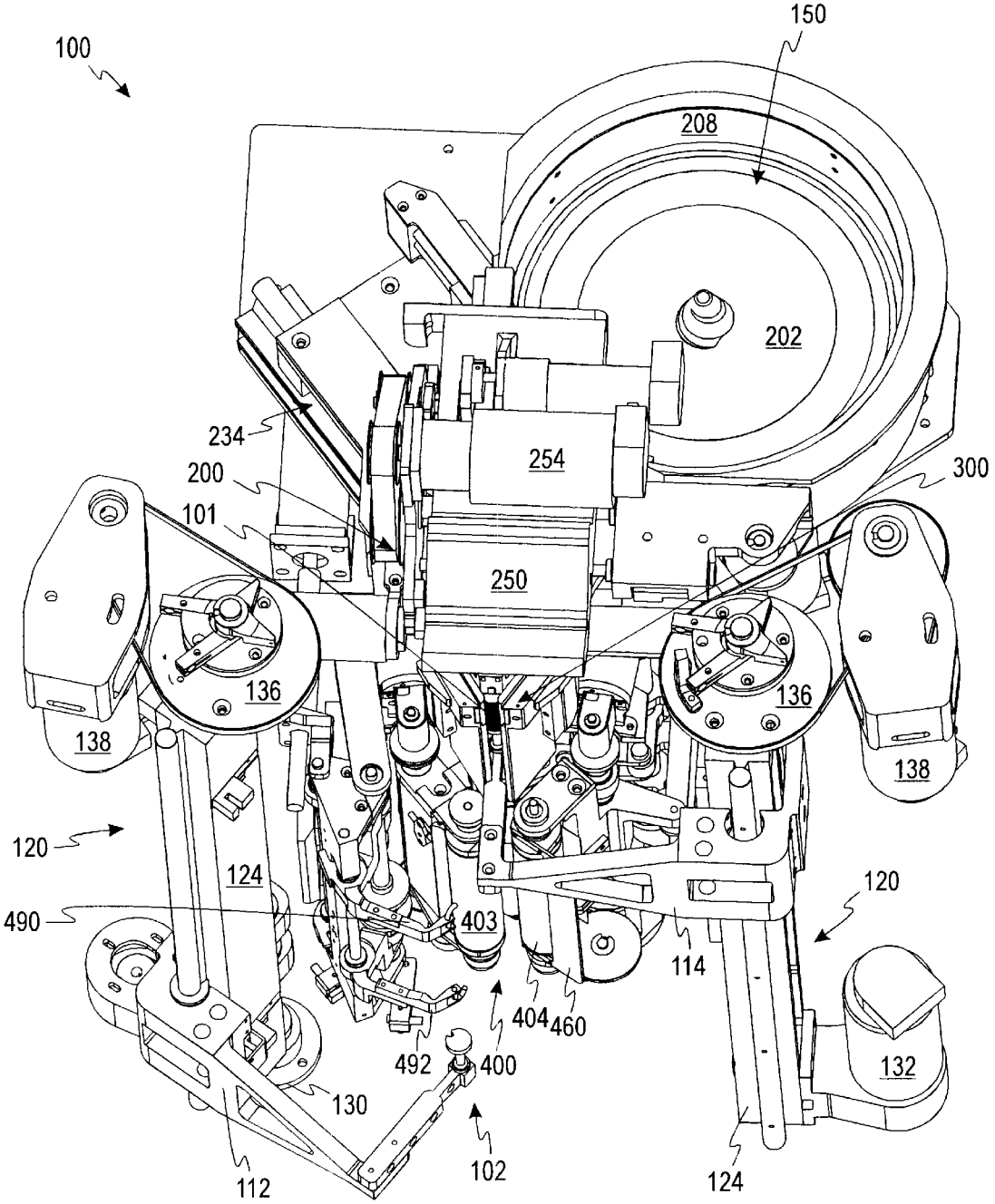
FIG. 4 is a top perspective view of a coin wrapper according to one embodiment of the present invention.
Figure 12:
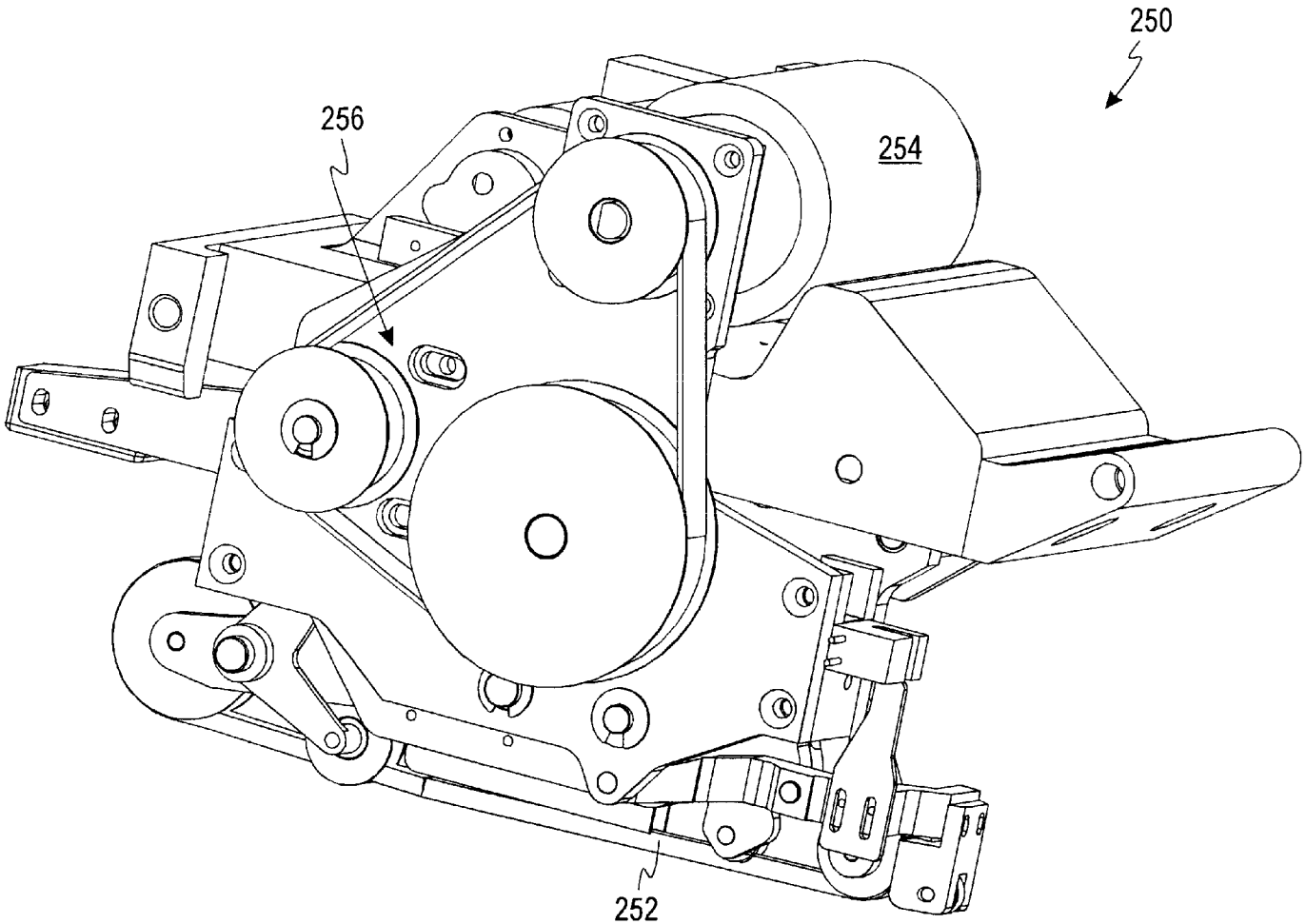
FIG. 12 is a left side perspective view of a coin belt drive mechanism for a coin wrapper according to one embodiment of the present invention.
Figure 13:
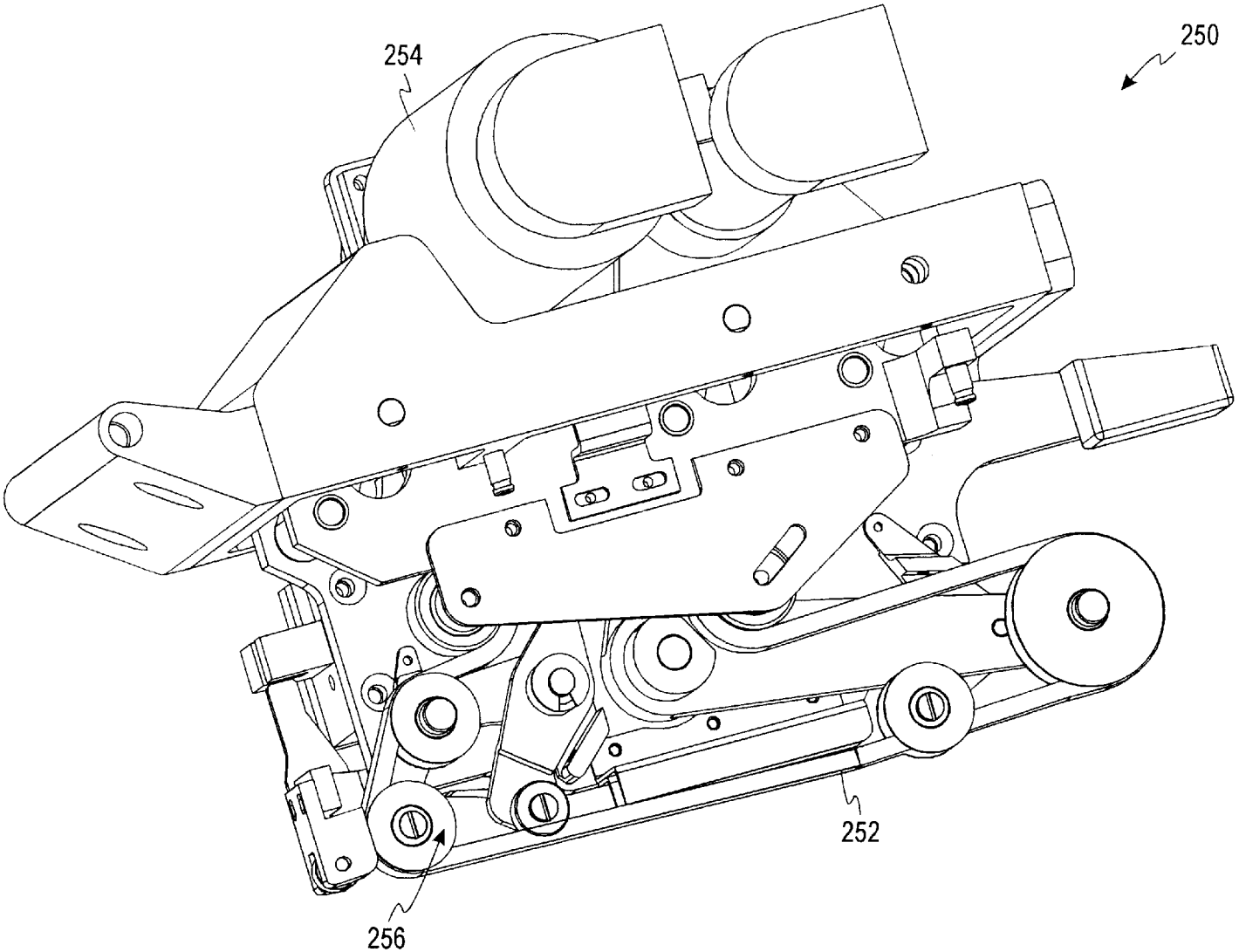
FIG. 13 is a right side perspective view of a coin belt drive mechanism for a coin wrapper according to one embodiment of the present invention.

Referring now to FIGS. 12 and 13 a drive mechanism 250 for the coin track 204 is illustrated in greater detail. The drive mechanism 250 is disposed above the queuing mechanism 200 as shown in FIG. 1. The drive mechanism 250 turns a coin track belt 252 which provides movement to the coins 201 along the coin track 204 from the coin table 202 to the stacking region 300. The drive mechanism 250 is powered by a motor 254. The motor 254 is coupled to the coin track belt 254 though a series of belts, shafts, and pulleys referred to generally with reference number 256.

The coin track drive belt 252 is disposed above the coin track 204 and engages the top surface of the coins as the drive belt 252 move the coins 201 along the floor 228 of the coin stack 204. The coin track drive belt 252 is disposed above the floor 228 of the coin track 204 a distance which is slightly less than the thickness of the particular coin denomination to be wrapped. The drive belt 252 is forced down on top of the top surface of the coins which provides the necessary friction for the drive belt 252 to engage the top surface of the coins so that the coins are moved along the coin track 204 with out slipping. The height at which the drive belt 252 is disposed above the coin track floor 228 is varied for each coin denomination to be wrapped. Accordingly, the drive belt 252 is moveable among a plurality of set-up positions corresponding to a plurality of coin denominations to be wrapped.

In one embodiment of the coin wrapper 100 of the present invention, the speed at which the coin wrapper 100 operates varies according to the particular coin denomination to be wrapped. In other embodiments, the speed at which the coin wrapper 100 depending on selection by the user. Accordingly, the speed at which the coin track drive belt 252 advances coins along the coin track 204 can be varied according to the particular coin denomination to be wrapped. In one embodiment, it may be preferable to advance larger diameter coins, e.g. quarters, along the coin track 204 at a rate faster than smaller diameter coins, e.g. dimes. Quarters have a larger diameter which requires a longer time to axially align quarters and feed the quarter to the stacking region 300 than for dimes.

Figure 14:
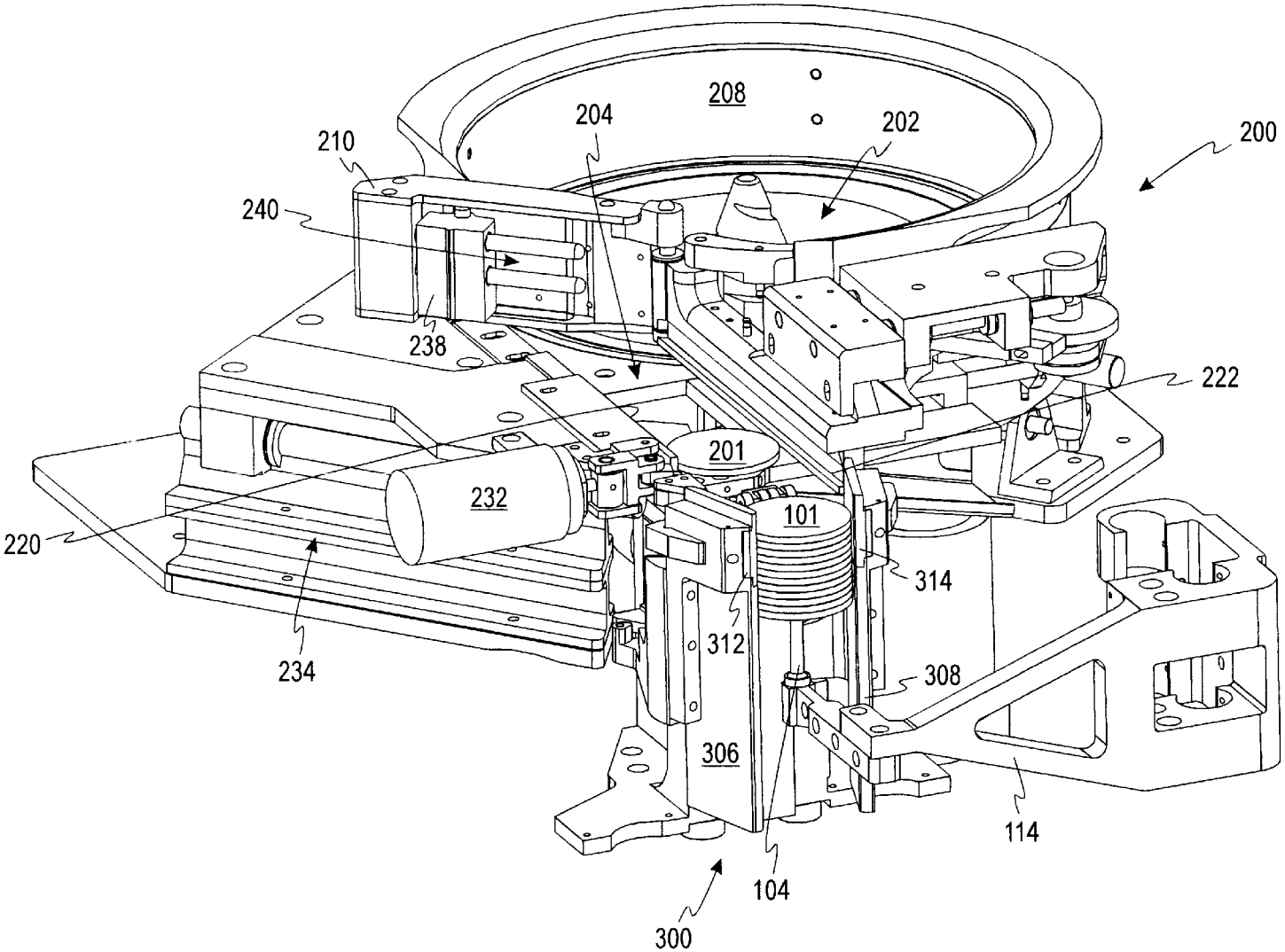
FIG. 14 is a front perspective view a of coin queuing mechanism and a stacking region spatially adjusted to accommodate a coin/token denomination having a larger diameter for a coin wrapper according to one embodiment of the present invention.
Figure 15:
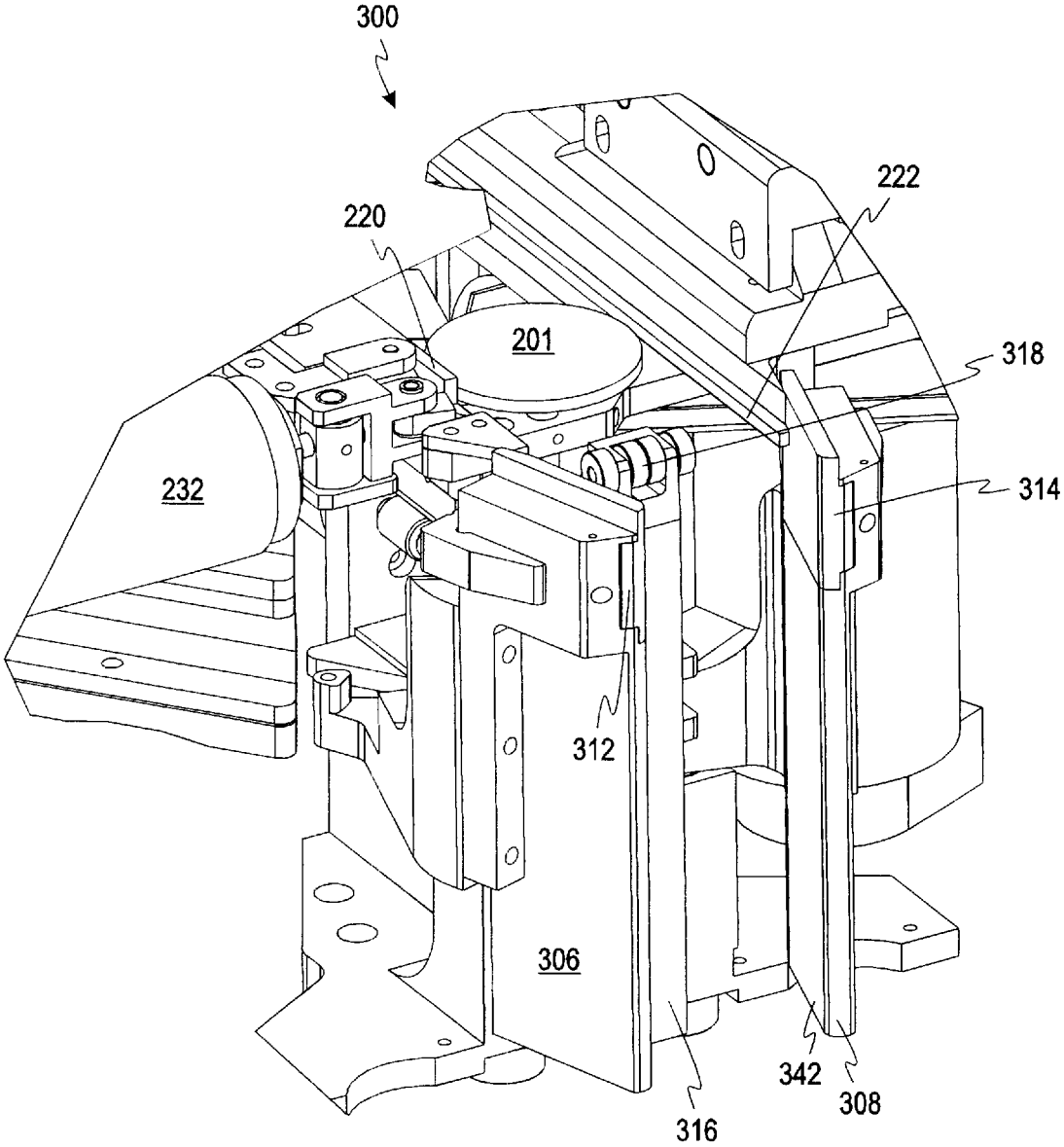
FIG. 15 is a close-up view of a stacking region for a coin wrapper spatially adjusted to accommodate a coin/token denomination having a larger diameter for a coin wrapper according to one embodiment of the present invention.

Referring to FIGS. 14 and 15, the stacking region 300 of the coin wrapper 100 is shown in greater detail. It should be noted that the coin wrapper 100 illustrated in FIGS. 14 and 15 is spatially set-up to accommodate a five dollar casino token 120 (one of the largest sized coin/token currently known to applicants). The coin track 204 directs the coins to the stacking region 300 where coins are stacked on the coin shuttle 104 to create a coin stack. The coin shuttle 104 is coupled to an arm 114 which is used to reciprocally move the coin shuttle 104 between the stacking region 300 and the wrapping region 400. The stacking region 300 includes a first guide wall 306 and a second guide wall 308 disposed generally to the left and the right, respectively, of the stacking region 300. The area bound by the first and second guide walls 306,308 and the terminal end 230 of the coin track is generally triangular in shape. The guide walls 306,308 aid in maintaining the axial alignment of the coins making up the coin stack 303.

Upon receipt of input from the user regarding the denomination of the batch of coins to be wrapped, the various components of the stacking region 300 are moved to one of a plurality of set-up positions which corresponds to the plurality of coin denominations to be wrapped. Accordingly, the guide walls 306,308 move to a predetermined position or a set-up position corresponding to the coin denomination to be wrapped. The coin shuttle 104 is moved to the stacking region 300 within the area bounded by the guide walls 306,308 to a predetermined vertical position corresponding to the particular coin denomination to be wrapped. The vertical set-up position of the coin shuttle 104 varies slightly depending on the thickness of the particular coin denomination to be wrapped.

Once the components of the stacking region 300 are moved to their respective set-up positions, the stacking region 300 is ready to being stacking coins. Coins are delivered to the stacking region 300 via the coin track 204. A sensor (not shown), disposed at the terminal end 230 of the coin track 204, monitors the delivery of each coin onto the coin shuttle 104. Once the first coin is delivered to the stacking element, the arm 114 descends thus downwardly moving the coin shuttle 104 an incremental distance in the vertical direction which is substantially equal to the thickness of the particular coin denomination being wrapped. The next coin is stacked upon the first coin deposited on the coin shuttle 104. Coins are deposited on the coin shuttle 104 in this manner until the last in a predetermined number of coins, e.g. the number of coins in the coin stack, passes the sensor disposed at the terminal end 230 of the coin track 204. At that time the solenoid 232 advances the stop pawl 228 to suspend delivery of coins to the wrapping region 300.

The first guide 306 and the second guide 308 aid in maintaining the axial alignment of the coins within the wrapping region 300. A back vertical support 318 also aides in the alignment of the coins and the supporting of the coin stack 101. The back vertical support 318 supports the edge of the coin most proximate the coin track 204. As the coins are delivered to the stacking region 300 via the coin track 204, it is the coin track drive belt 252 which provides movement to the coins 201. As the coins 201 are moved off of the terminal end 230 of the coin track 204, the coins have an amount of momentum which enables the coins to slide across the top of the coin stack. A roller positioned at the terminal end 230 of the coin track 204 facilitates the transition of the coins from the coin track 204 to the coin stack 201. Because the coins 201 are imparted a momentum, the coins 201 tend to slide across the top of the coin stack 201. The guide walls 306,308 prevent any further forward advancement of the coins. The coin shuttle 104 descends vertically with the addition of each coin to the coin stack while the back vertical support 316 and the guide walls 306,308 support and align the coin stack.

Figure 16:
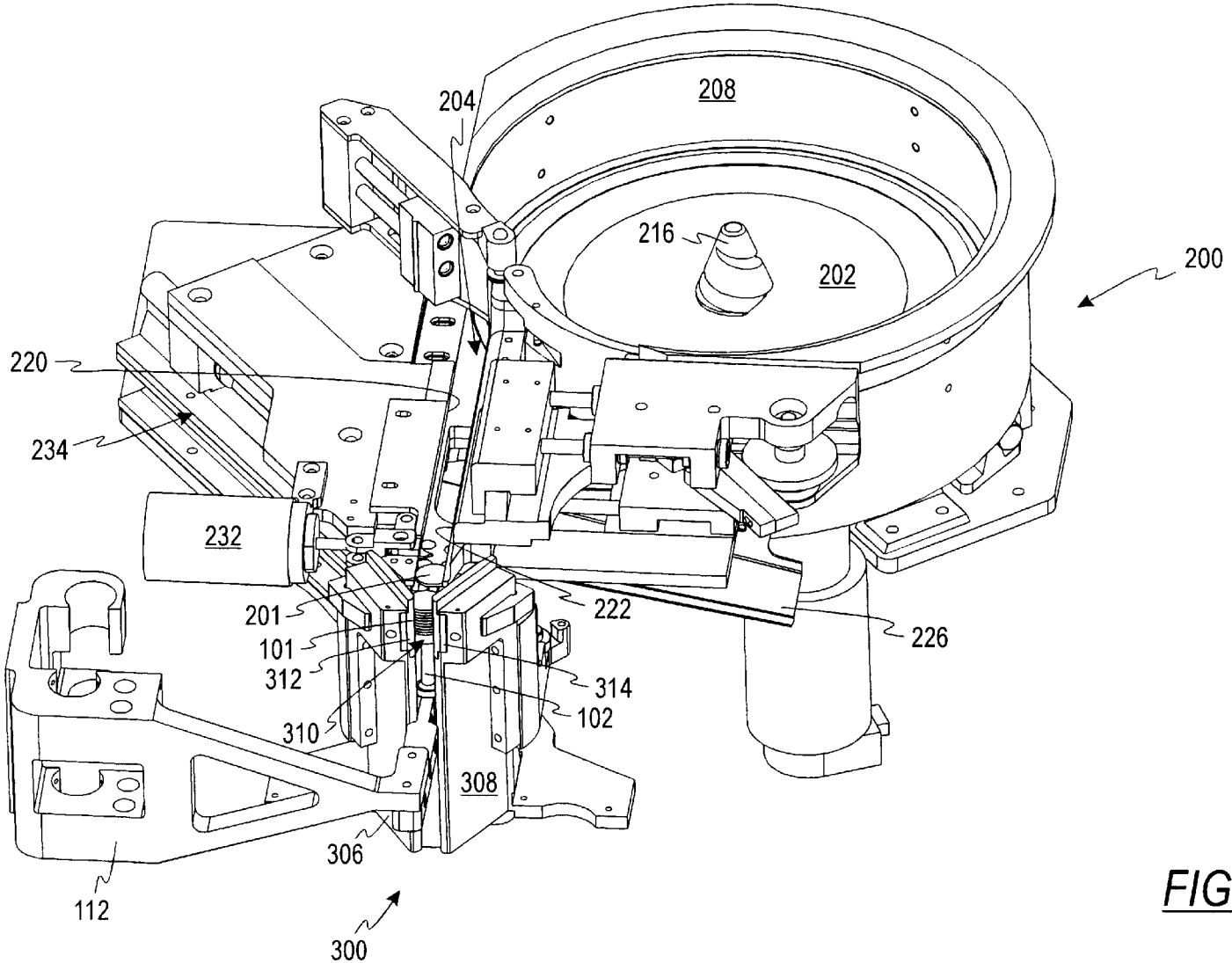
FIG. 16 is a front perspective view a of coin queuing mechanism and a stacking region spatially adjusted to accommodate a coin/token denomination having a smaller diameter for a coin wrapper according to one embodiment of the present invention.
Figure 17:
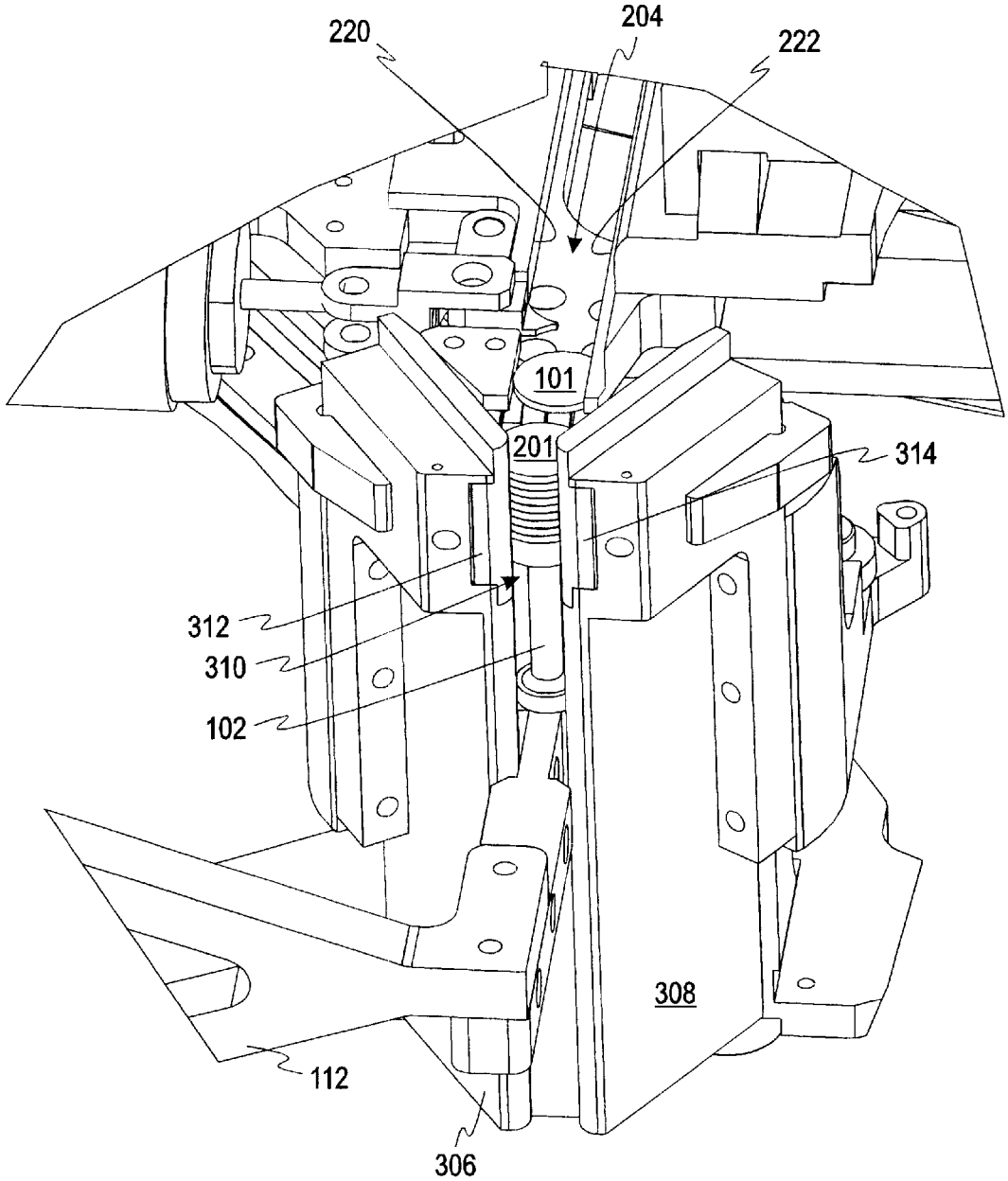
FIG. 17 is a close-up view of a stacking region for a coin wrapper spatially adjusted to accommodate a coin/token denomination having a smaller diameter for a coin wrapper according to one embodiment of the present invention.

Referring now to the embodiments of the wrapping region 300 illustrated in FIGS. 16 and 17, the coin wrapper 100 is spatially adjusted to accommodate a coin/token denomination such as the Holland dime which is the smallest coin/token currently known to applicants. The stacking region 300 includes a gate 310 disposed within the guide walls 306,308 for use in wrapping smaller diameter coins. The Holland dime has a diameter of approximately 0.59 inches (approximately 1.50 cm). The coin shuttle 104 has a diameter of approximately 0.58 inches (approximately 1.47 cm). The start-up position of the guide walls 306,308 corresponding to the Holland time results in narrow gap 330 between the first 306 and the second 308 guide walls as illustrated in FIGS. 16 and 17. The gap 330 is wide enough to allow an end 332 of the arm 114 and the vertical component 334 of the coin shuttle 104 to pass through. However, the coin shuttle 104 itself is too wide to pass though the gap 330 between the stacker walls 306,308. Therefore, the gate 310 is provided to allow the coin shuttle 104 to horizontally enter the stacking region 300. As an empty coin shuttle 104 is brought up from the wrapping region 400, the arm 114 ascends thus vertically moving the coin shuttle 104 to a point which is substantially level to the coin shuttle start-up position. The arm 114 then rotates thus horizontally moving the coin shuttle 302 into the stacking region 300.

The gate 310 comprises a first shutter 312 disposed in the first guide wall 306 and a second shutter 314 disposed in the second guide wall 308. Each shutter 312,314 is biased in the closed position by an internal spring (not shown). The gate 310 is opened by the force imparted onto the each of the shutters 314,316 as the coin shuttle 104 presses against the gate 310 when horizontally moving into the stacking region 300. The gate 310 snaps back into the closed position once the coin shuttle 104 has moved a distance sufficient to clear the gate 310. Each of the shutters 314,316 have a back surface 340 which is substantially flush with a back surface 342 of each of the guide walls 306,308. Having flush surfaces 340,342 removes the possibility that one or move coins in the coin stack may become disrupted on the interface between the back surfaces 340, 342 as the coin shuttle 102 vertically descends into the wrapping region 400.

Figure 18A:
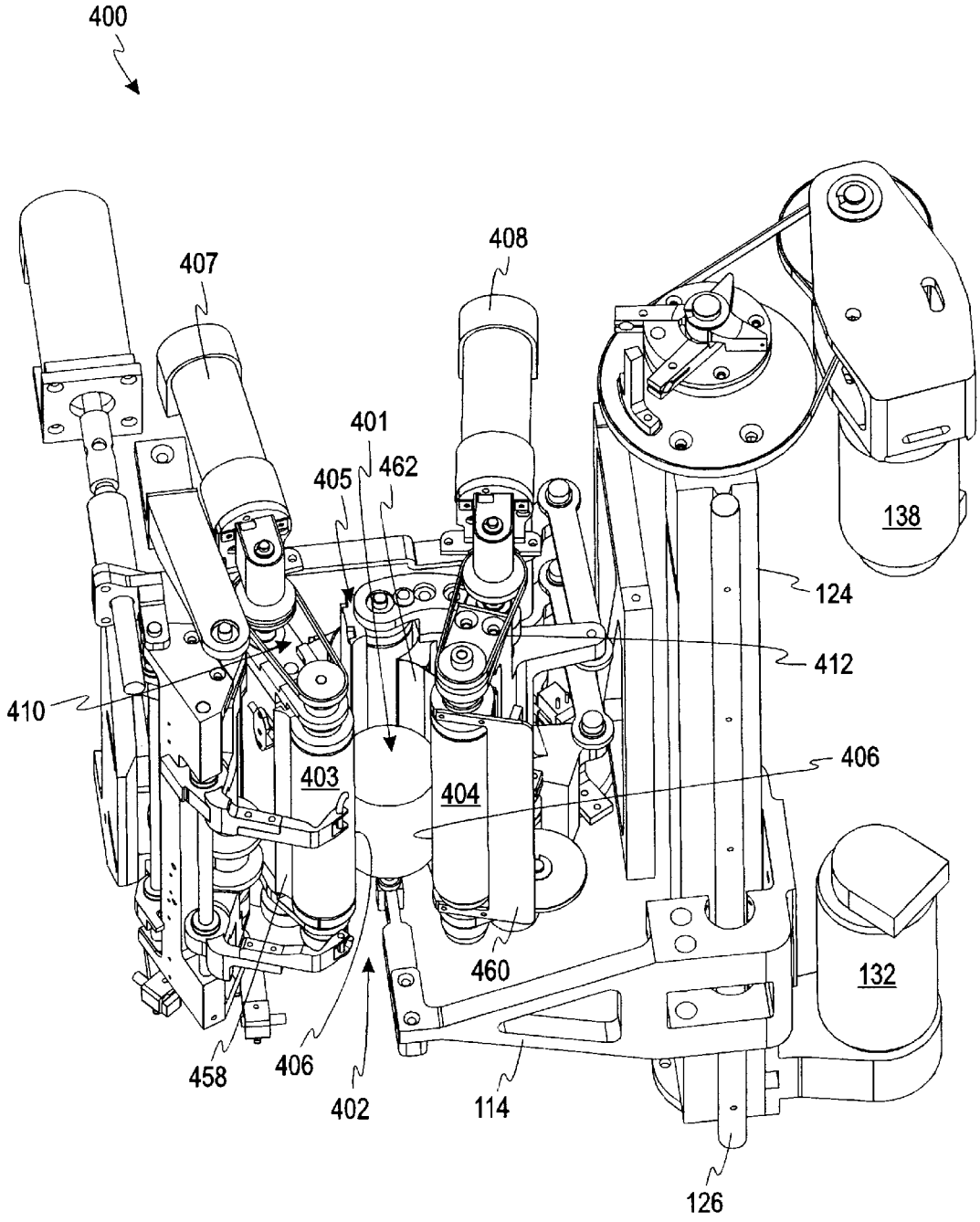
FIG. 18*a* is a front perspective view of a wrapping region for a coin wrapper according to one embodiment of the present invention.

Referring now to FIGS. 18*a,* 18*b,* 19, and 20, the wrapping region 400 of the coin wrapper 100 receives a stack of coins 401 from the stacking region 300 to wrap paper around the coin stack 401. The wrapping region 400 contains three wrapping rollers 402, including a first 403, a second 404, and a third 405 roller, for rotating the coin stack 401. Upon input from the user indicating the coin denomination to be wrapped, the three rollers 402 of the wrapping region 400 move into set-up positions. At the respective set-up positions, each roller 402 is physically positioned at a point wherein the area bounded by the innermost point on the rollers 402 is slightly larger than the cross-sectional area of the coin stack 401 to be wrapped. Once the arm 114 lowers the coin shuttle 104 having the coin stack 401 thereon into the wrapping region 400, the rollers 402 converge upon the coin stack 402 so that the innermost point 406 on the rollers 402 is touching the coin stack 401 as illustrated in FIGS. 18*a*–19. A motor 441 is coupled to the rollers for moving the rollers 402 among the plurality of set-up positions corresponding to a plurality of coin denominations to be wrapped and for moving the rollers into contact with the coin stack 401.

Figure 18B:
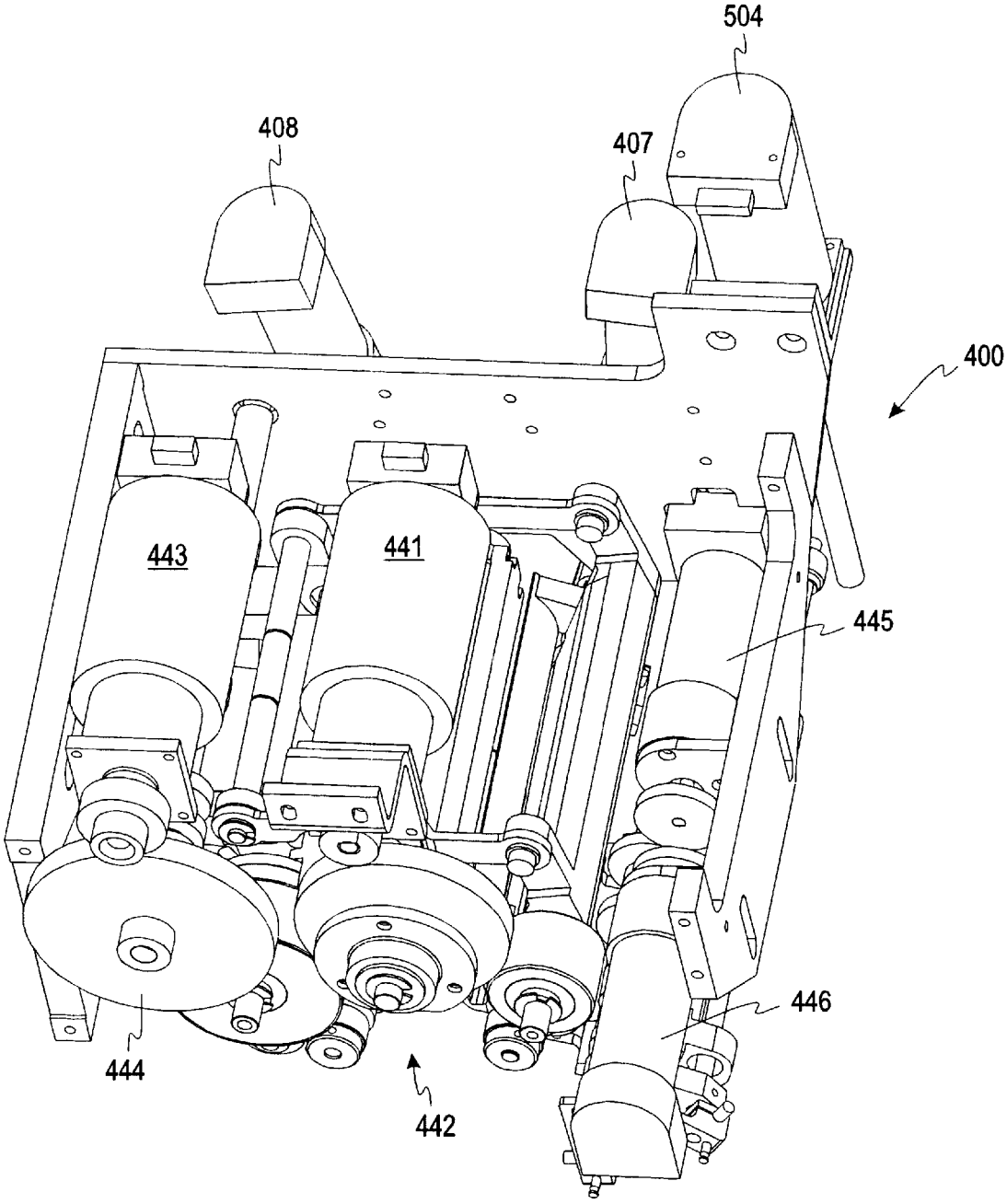
FIG. 18*b* is a bottom perspective view of a wrapping region for a coin wrapper according to one embodiment of the present invention.
Figure 19:
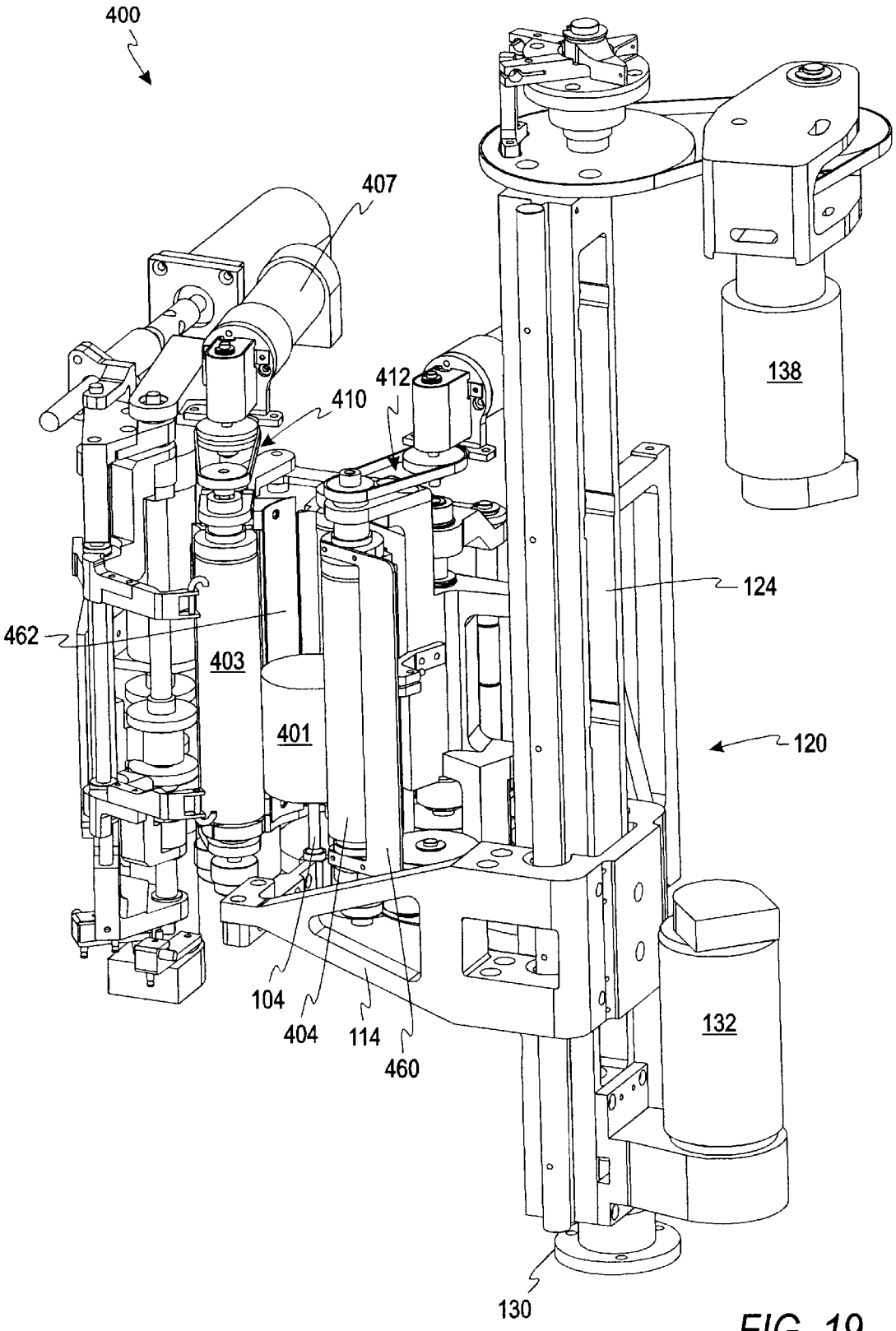
FIG. 19 is a right-side front perspective view of a wrapping region for a coin wrapper according to one embodiment of the present invention.
Figure 20:
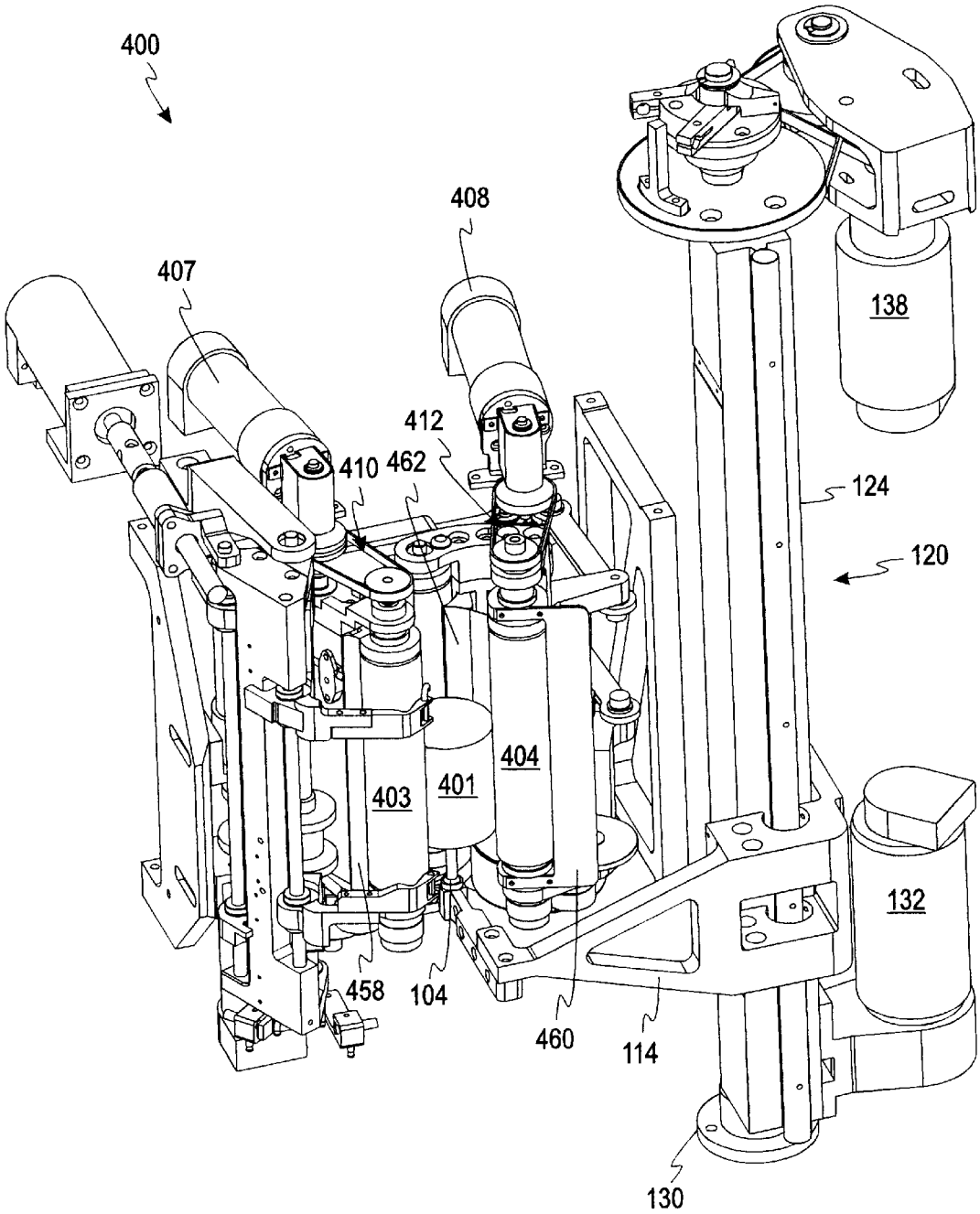
FIG. 20 is a left-side front perspective view of a wrapping region for a coin wrapper according to one embodiment of the present invention.

Referring specifically to FIG. 18*b,* at this point in the wrapping process the wrapping rollers 402 rotate in the clockwise direction thus rotating the coin stack in the counterclockwise direction. The rollers 402 are driven by the motor 441. The rollers 402 are coupled to the motor 441 via a gear train 442. While the coin stack 401 is being rotated by rollers 402, paper is introduced to the rotating coin stack 401. A motor 443 provides positional movement to the rollers 402 to move the rollers 402 among the plurality of set-up positions and to converge the rollers 402 upon the coin stack. The positional motor 443 is coupled to the rollers 402 via a gear 444. Motors 445,446 provide vertical movement to an upper and lower crimp arm 490,492, respectively (shown in detail in FIGS. 26 and 27).

Figure 21:
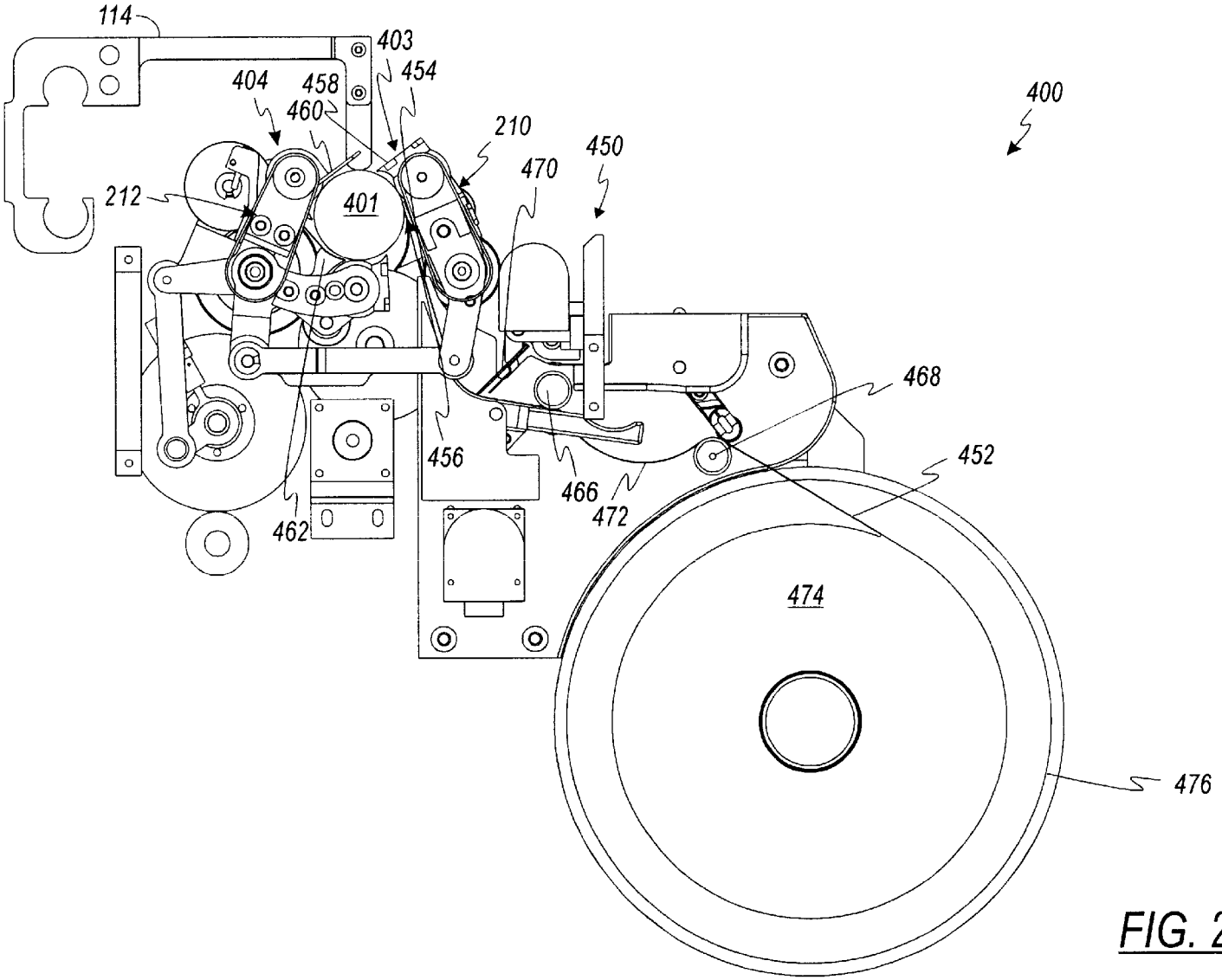
FIG. 21 is a top view of a wrapping region and a paper feed mechanism for a coin wrapper according to one embodiment of the present invention.
Figure 22:
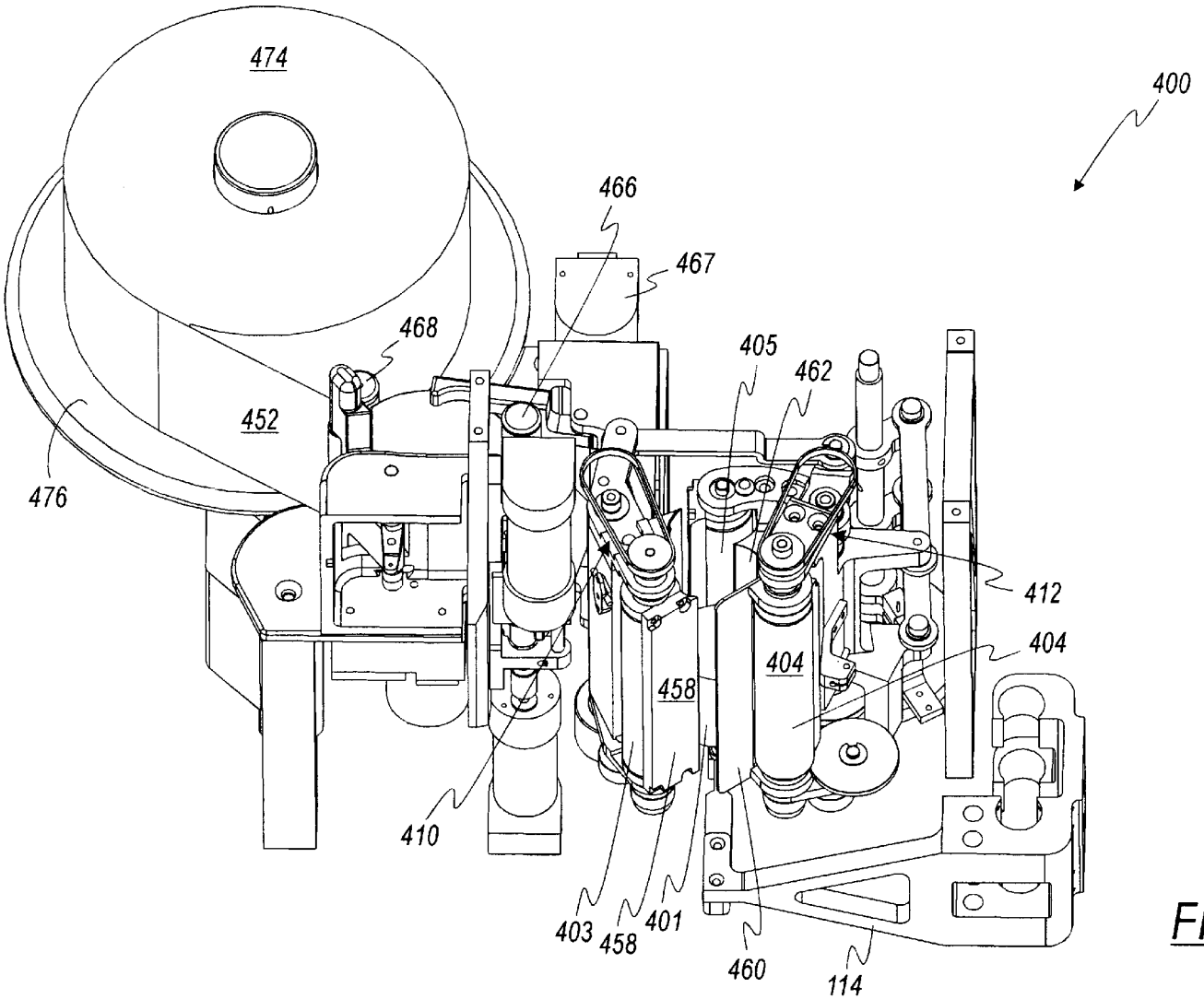
FIG. 22 is a front perspective view of a wrapping region and a paper feed mechanism for a coin wrapper according to one embodiment of the present invention.
Figure 23:
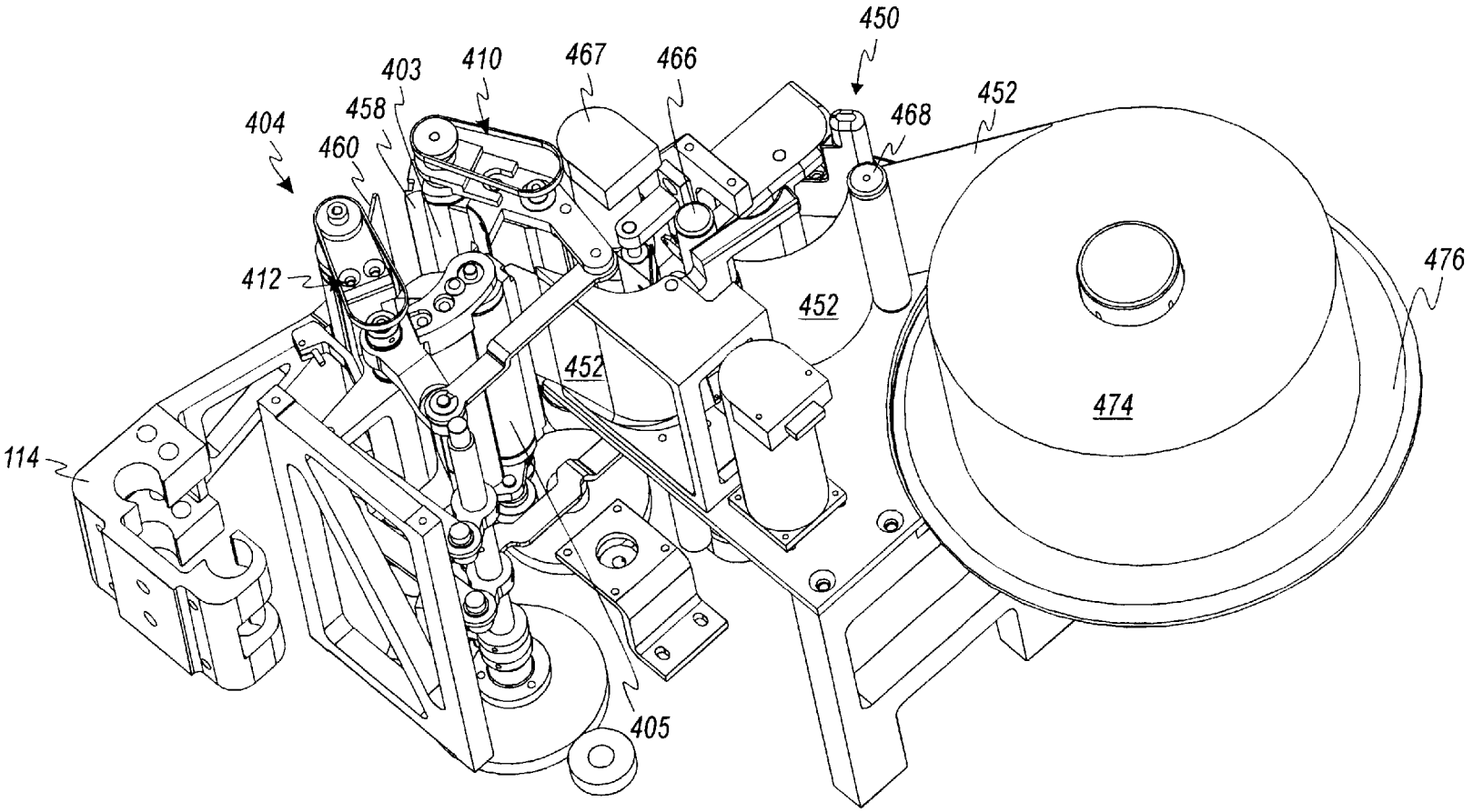
FIG. 23 is a rear perspective view of a wrapping region and a paper feed mechanism for a coin wrapper according to one embodiment of the present invention.

Referring also to FIGS. 21–23, the wrapping region 400 contains a paper feed mechanism 450 for introducing paper 452 to the rotating coins stack 401. A leading edge 454 of the paper 452 is introduced at to an interface 456 between the first roller 403 and the rotating coin stack 401. The leading edge 454 of the paper 452 is caught in the interface 456 and pulled in by the first roller 403 and the rotating coin stack 401. The paper 452 is then wrapped around the coin stack 401. Two complete layers of paper wrapped around each coin stack 401 is preferred. The wrapping region 400 includes a primary tucker guide 458 and a secondary tucker guide 460. The primary tucker guide 458 has a curved shape and directs the paper 452 around the coin stack 401 from the first roller 403 to the second roller 404. The secondary tucker guide 460 is used in conjunction with the wrapping of coins/tokens having large diameters (e.g. the U.S. quarter or larger). When larger diameter coin/tokens are wrapped, there is a larger space between the first roller 403 and the second roller 404. The secondary tucker guide 460 aides the first tucker guide 458 in directing the paper 452 from the first roller 403 to the second roller 404. More specifically, the secondary tucker guide 460 directs the paper 452 from the primary tucker guide 458 to the second roller 404. The secondary tucker guide 460 is pivotally mounted about the second roller 404 allowing the secondary tucker guide 460 to pivot away from the coin stack 401 being wrapped when not in use. The primary tucker guide 458 is pivotally mounted about the first roller 403. The position of the tucker guides 458,460 during wrapping is dependent on the coin denomination being wrapped; therefore, both the primary and secondary tucker guides 458,460 are each movable among a plurality of set-up positions corresponding to a plurality of coin denominations to be wrapped. A motor 407 is coupled via a timing pulley and chain 410 to the primary tucker guide 458 for moving the primary tucker guide 458 among the plurality of set-up positions corresponding to the plurality of coin denominations to be wrapped. Another motor 408 is coupled to the secondary tucker guide via a timing pulley and chain 412 for moving the secondary tucker guide 460 among the plurality of set-up positions corresponding to the plurality of coin denominations to be wrapped. In FIGS. 21–23, the primary tucker guide 458 and the secondary tucker guide 460 are shown in position converged around the coin stack 401. Whereas in FIGS. 18*a*–20, the tucker guides 458,460 are shown retracted from the coin stack 401. The wrapping region 400 contains other stationary paper guides 462 which are disposed adjacent the rollers 402 for guiding the paper 452 around the coin stack 401. In an alternative embodiment, curved sheets of a fiberglass/epoxy matrix are disposed adjacent the rollers 402 for guiding the paper 452 around the coin stack 401.

Referring specifically to FIG. 21, the paper feed mechanism 450 includes a main paper feed roller 466 and a pre-feed paper roller 468. The main paper feed roller 466 is coupled to a motor 467 which actuates the main paper feed roller 466. Before each coin stack 401 is wrapped, the main feed paper roller 450 advances the leading edge 454 of the paper 452 past a knife 470 to a point adjacent the interface between the coin stack 401 and the first wrapping roller 403. Meanwhile, the pre-feed roller 468 advances a length of paper 452 to form a web 472 of paper 452 from a paper roll 474 on a paper holder 476. The web 472 of paper has sufficient length to permit two complete layers of paper to be wrapped around the coin stack 401. The length of paper 452 advanced will be different for each of the plurality of coin denominations to be wrapped. Once the coin stack 401 has been lowered into the wrapping region 400 and the rotation of the coin stack 401 begins, the leading edge 454 of the paper 452 is advanced to the interface 456 between the first wrapping roller 403 and the rotating coin stack 401 where the paper 452 is pulled in and subsequently wrapped around the coin stack 401. The speed at which the primary paper feed roller 466 advances the leading edge 454 of the paper 452 to the interface 456 is slightly faster than the speed at which the paper 452 is circumferentially pulled around the periphery of the coin stack 401 to avoid tearing of the paper 452. Because the coin wrapper 100 is able to wrap different coin denominations at different speeds, the primary paper feed roller 466 is able to advance the leading edge 454 of the paper 452 to the interface 456 at a plurality of speeds corresponding to a plurality of coin denominations to be wrapped. Once the web 472 of paper 452 has been taken up the paper 452 is pulled against the knife 470 which cuts the paper 452.

Figure 24:
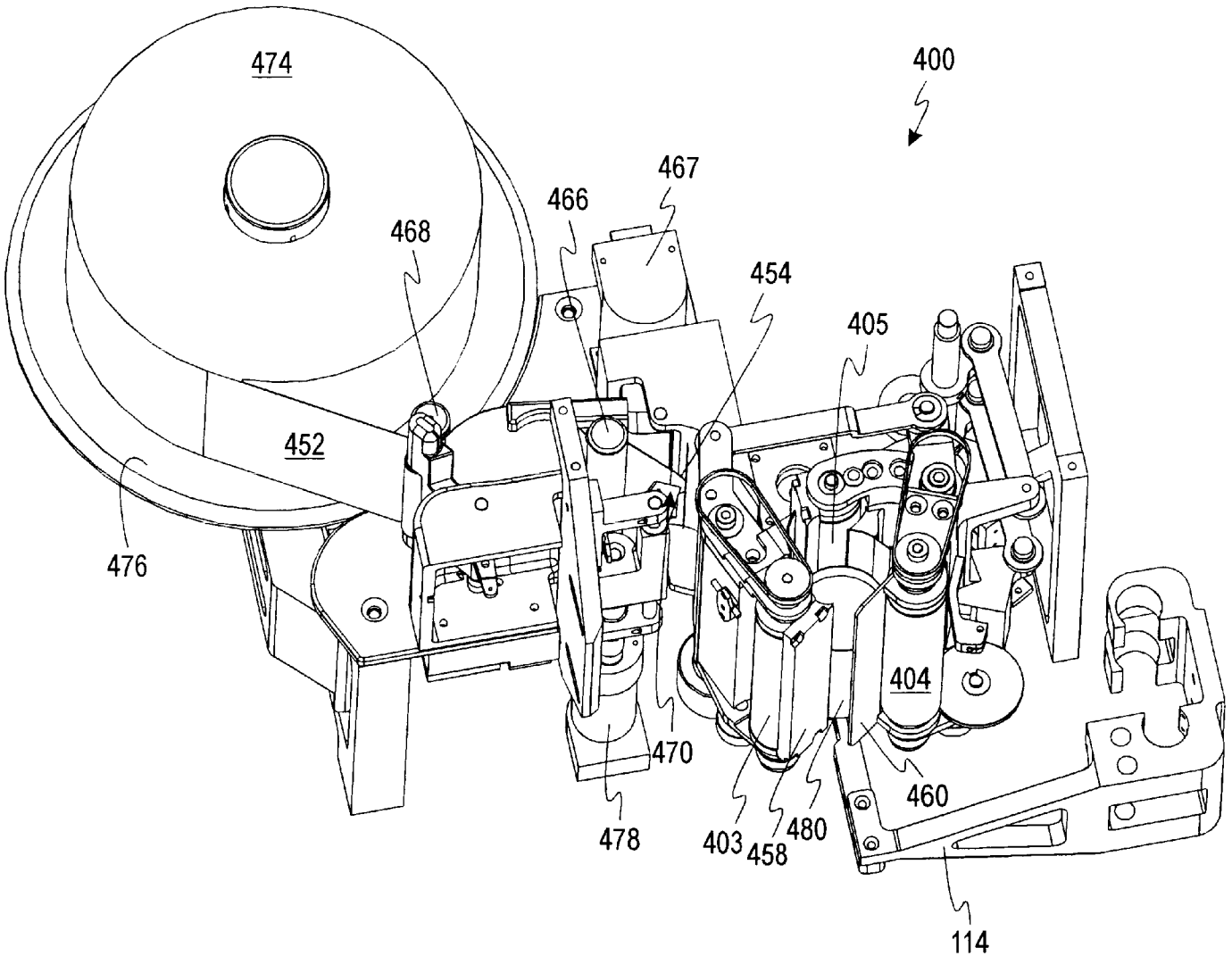
FIG. 24 is another front perspective view of a wrapping region and a paper feed mechanism for a coin wrapper according to one embodiment of the present invention.
Figure 25:
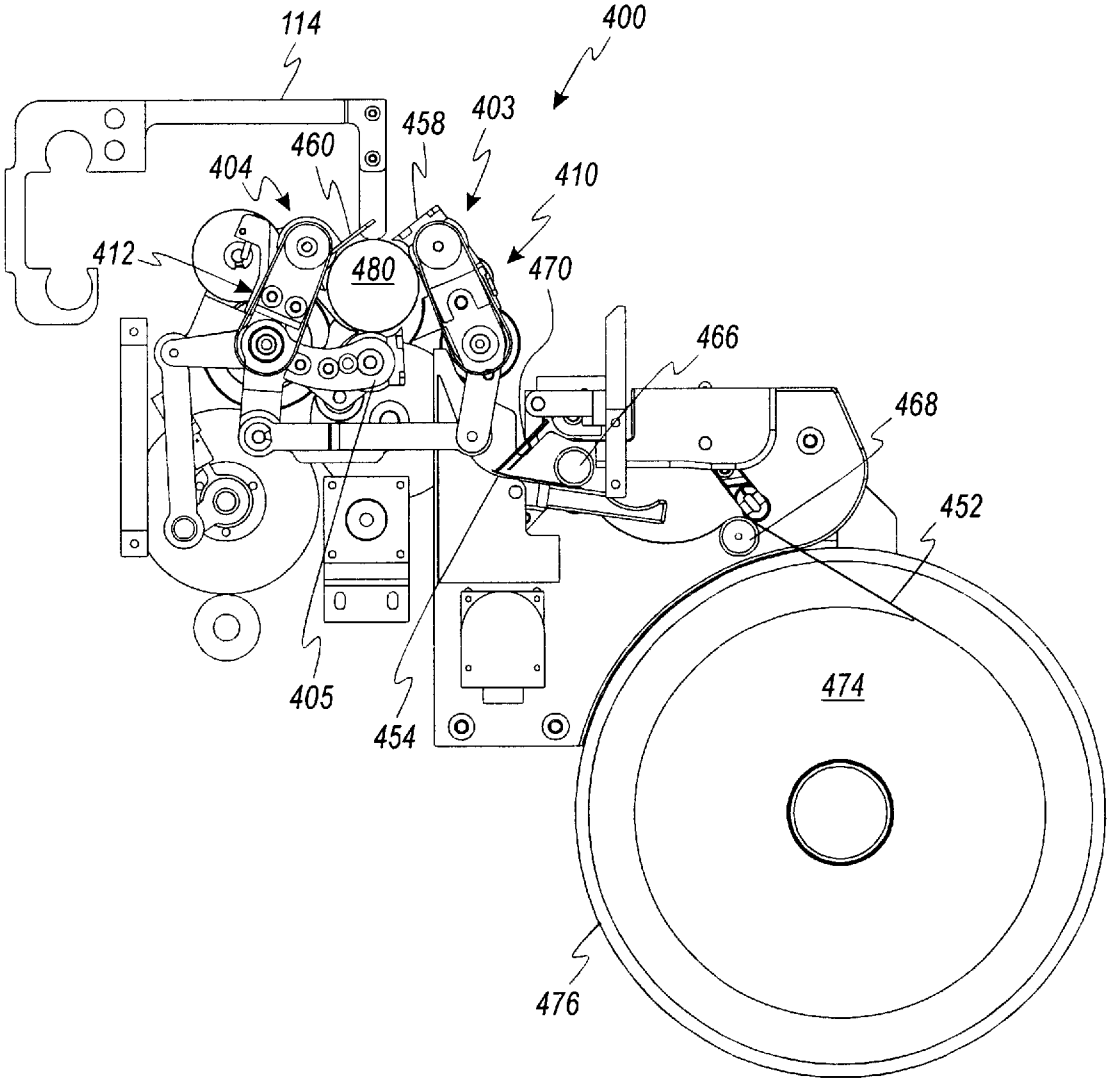
FIG. 25 is another top view of a wrapping region and a paper feed mechanism for a coin wrapper according to one embodiment of the present invention.

Referring now to FIGS. 24 and 25, a new leading edge 454 is formed after the paper has been thrust against the knife 470. After the paper has been cut, the new leading edge 454 is formed at the knife 470 and is then forwardly advanced in anticipation of the next coin stack to be wrapped. The pre-feed paper roller 468 then creates a new web of paper 452 in anticipation of the next coin stack to be wrapped. The width of the paper 452 varies for each denomination of coins/tokens to be wrapped. The knife 470 is vertically adjustable to accommodate paper 452 of different widths. The knife is coupled to a motor 478 to adjust the vertical position of the knife.

Figure 26:
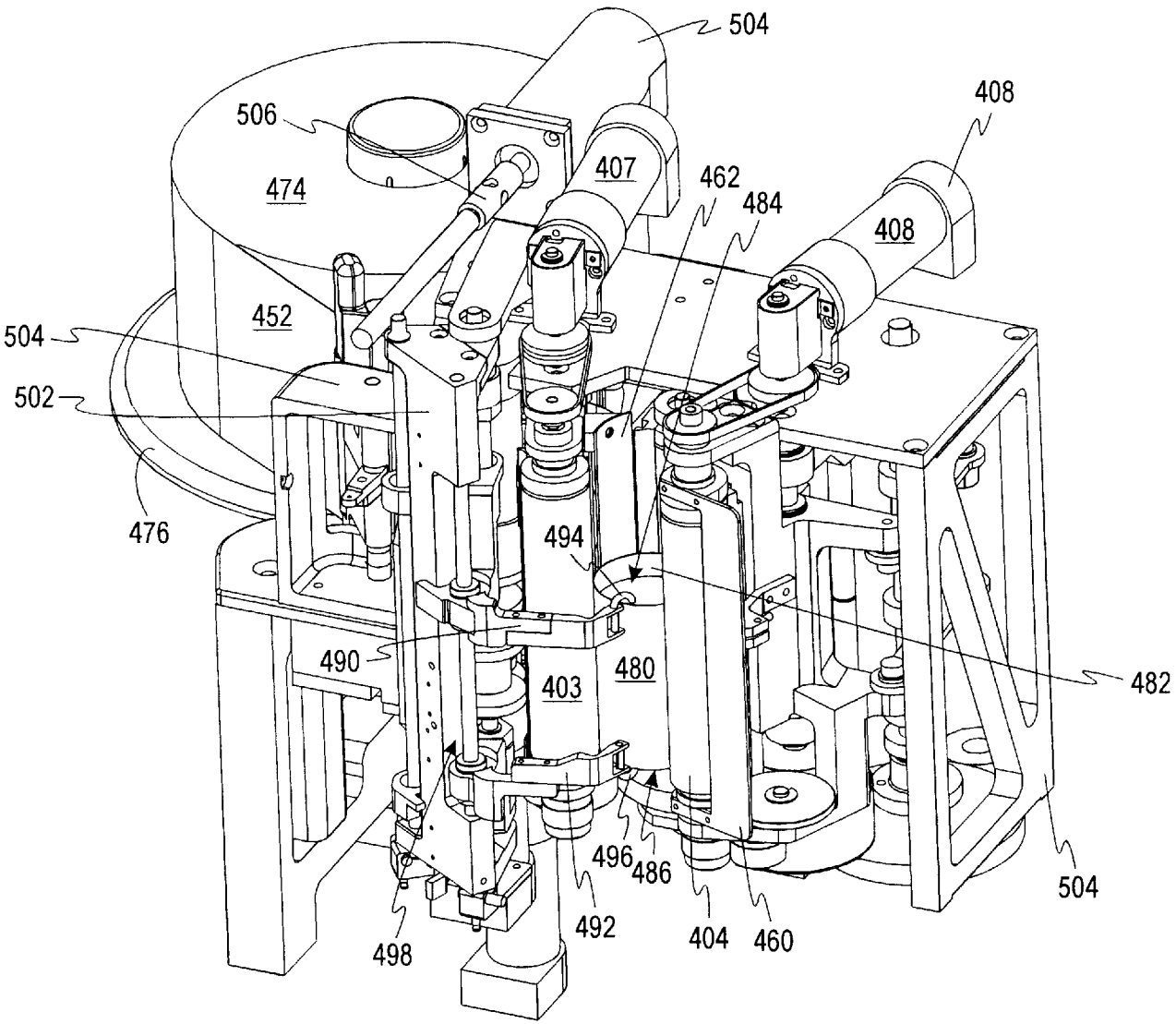
FIG. 26 is a front perspective view of a wrapping region for a coin wrapper showing paper wrapped around a coin stack according to one embodiment of the present invention.

Referring to FIG. 26, a coin stack 480 is illustrated having paper wrapped around the coin stack 480. The width of the paper 452 is greater than the height of the coin stack 480 which results in a excess paper 482 extending beyond an upper 484 and a lower 486 end of the wrapped coin stack 480. The excess paper 482 is crimped at the upper 484 and lower 486 ends of the wrapped coin stack 480 to create a paper toroid which binds the paper holding the wrapped coin stack 480 together. The crimping is accomplished by an upper and a lower crimp arm 490,492 which are both moveable in the horizontal and vertical directions. Each crimp arm 490,492 has a crimp hook 494,496 attached thereto. The crimp arms 490,492 are slidably engaged to a track 498 which is part of a crimp arm module 502. Each crimp arm 490,492 is movable in the vertical direction along the track 498 of the module 502. The crimp arm module 502 is pivotally mounted to a structure 504. Horizontal movement is provided to the crimp arms 490,492 by the pivoting of the crimp arm module 502. A motor 504 is coupled to the module 502 via a lead/nut screw assembly 506 to provide the horizontal movement to the crimp arms 490,492. Vertical movement is provided to the crimp arms 490,492 by motors 445,446 (shown in FIG. 18*b*), respectively. The crimp hooks 494,496 are vertically positioned at a point slightly above and slightly below the upper and lower ends 484,486, respectively, of the rotating wrapped coin stack 480. The crimp arms 490,492 then horizontally move the crimp hooks 494,496 radially inward past the periphery and towards the center of the wrapped coin stack 480. When the crimp arms move radially inward past the periphery of the wrapped coin stack 480, the paper 482 extending above and below the upper and lower ends 484,486 of the coin stack is pushed over. Then the crimp arms 490,492 are pulled radially away from the center of the wrapped coin stack 480 to a point slightly inward from the periphery of the wrapped coin stack 480. The wrapped coin stack 480 continues to rotate causing the hooks 494,496 to crimp the excess paper 482 at the upper and lower ends 484,486 of the wrapped coins stack 480 to create a paper toroid 508 at the upper and lower ends 484,486 of the wrapped coin stack 480 to bind the paper 452.

Figure 27:
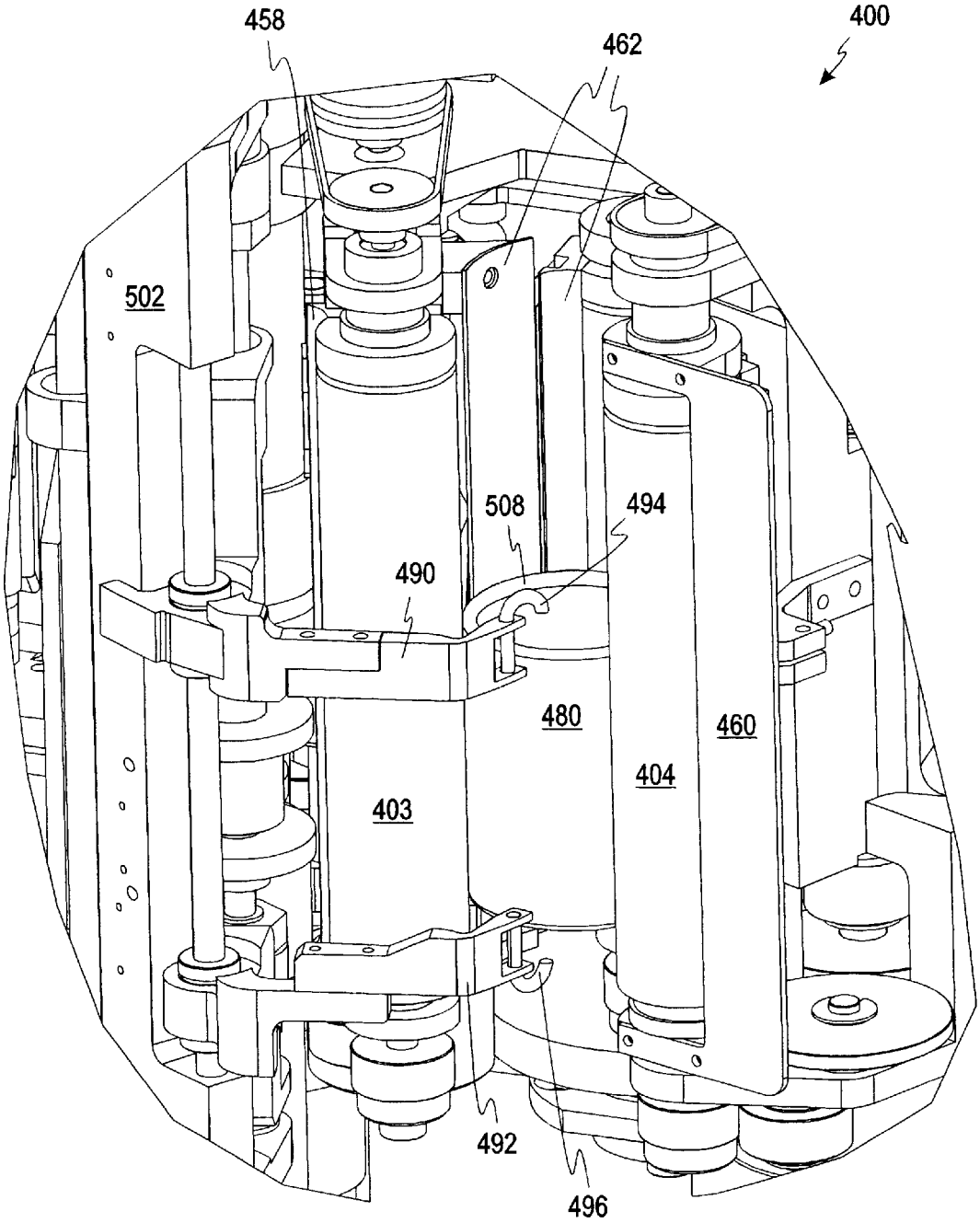
FIG. 27 is a close-up view of a wrapping region for a coin wrapper showing the crimped paper wrapped around a coin stack according to one embodiment of the present invention.

Referring to FIG. 27, a toroid 508 is formed at the upper and lower ends 484,486 of the wrapped coin stack 480. After the crimping process is complete, the upper and lower crimp arms 490,492 move vertically away from the wrapped coin stack 480 and then pivot horizontally away from the wrapping rollers 402. After the crimp arms 490,492 have pivoted away from the wrapping rollers 402, the arm 104 moves the second coin shuttle 104 out of the wrapping region 400. The second coin shuttle 104 must first vertically descend from the wrapping region 400. The wrapping rollers 402 physically hold the wrapped coin stack 480. After the second coin shuttle 104 has descended a distance sufficient to clear the wrapping rollers 402, the second coin shuttle 104 then horizontally pivots away from the wrapping region 400. The rollers 402 diverge thus allowing the wrapped coin stack 480 to fall under the force of gravity. The first coin shuttle 102 with a stack of coins thereon descends vertically into the wrapping region 400 while the second coin shuttle 104 is ascending towards the stacking region 300 to receive another coin stack.

Figure 28:
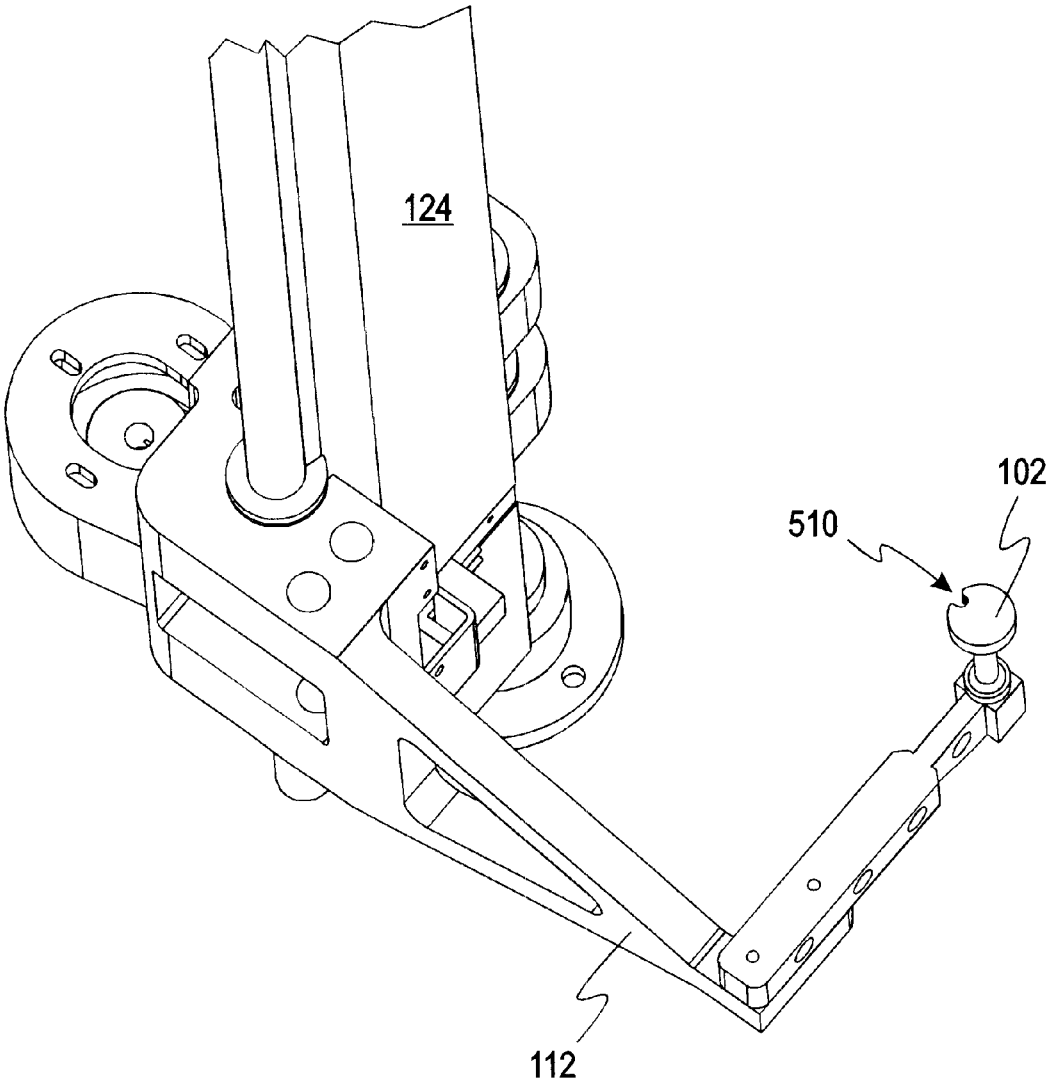
FIG. 28 is a perspective view of an arm and a coin shuttle for a coin wrapper according to one embodiment of the present invention.

Referring to FIG. 28, the coin shuttle 104 has a slot 510 disposed therein. Because the diameter of the coin shuttle 102 is only slightly smaller than the diameter of the smallest coin/token denomination to be wrapped, the slot 510 permits the lower crimp hook 496 to crimp the paper 482 at the lower end 486 of the wrapped coin stack 480 when wrapping coin denominations have smaller diameters. While only the first coin shuttle 102 is illustrated in FIG. 28, the second coin shuttle 104 also has a slot 510 disposed therein.

Figure 29:
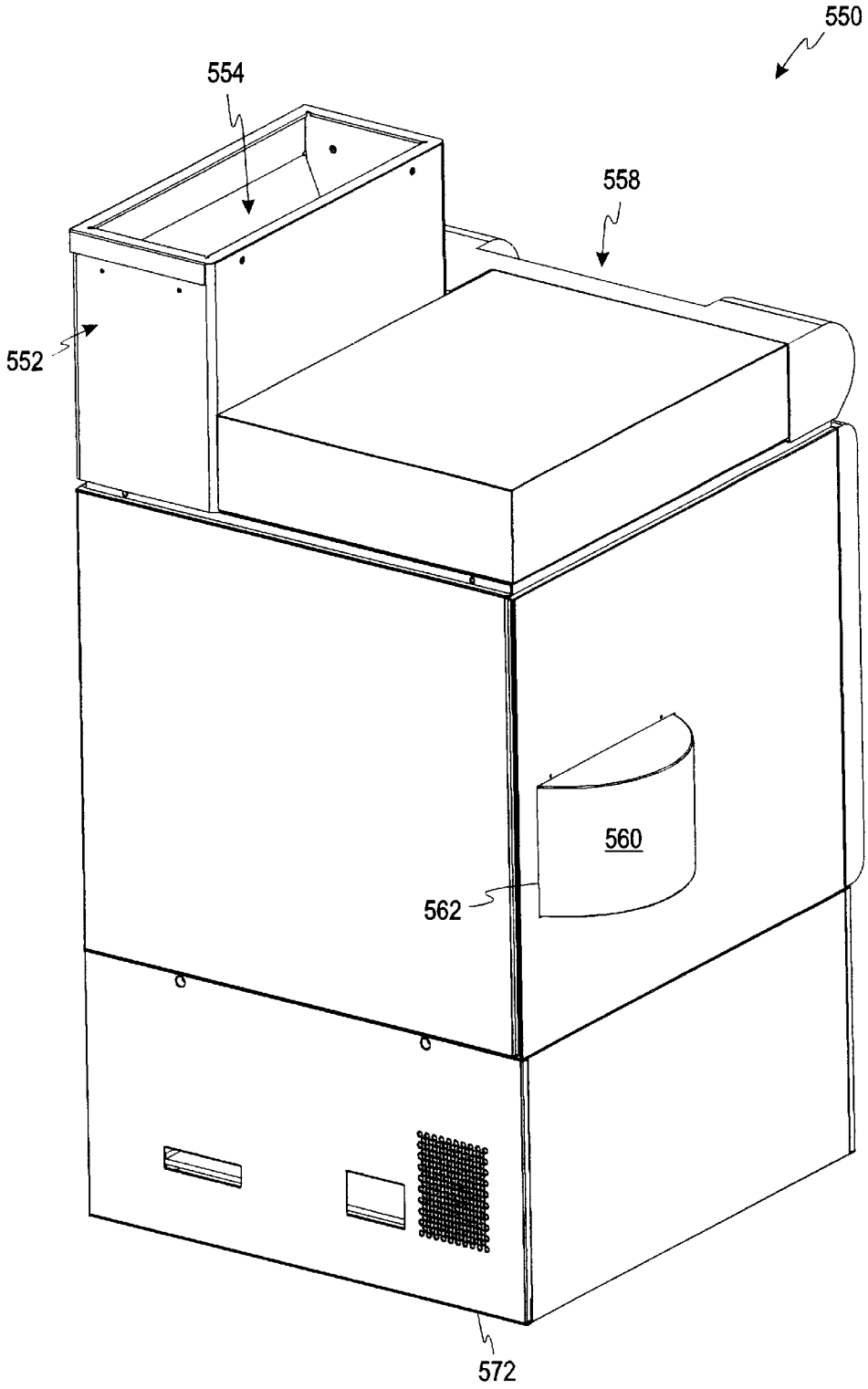
FIG. 29 is a rear perspective view of a housing for a coin wrapper according to one embodiment of the present invention.
Figure 30:
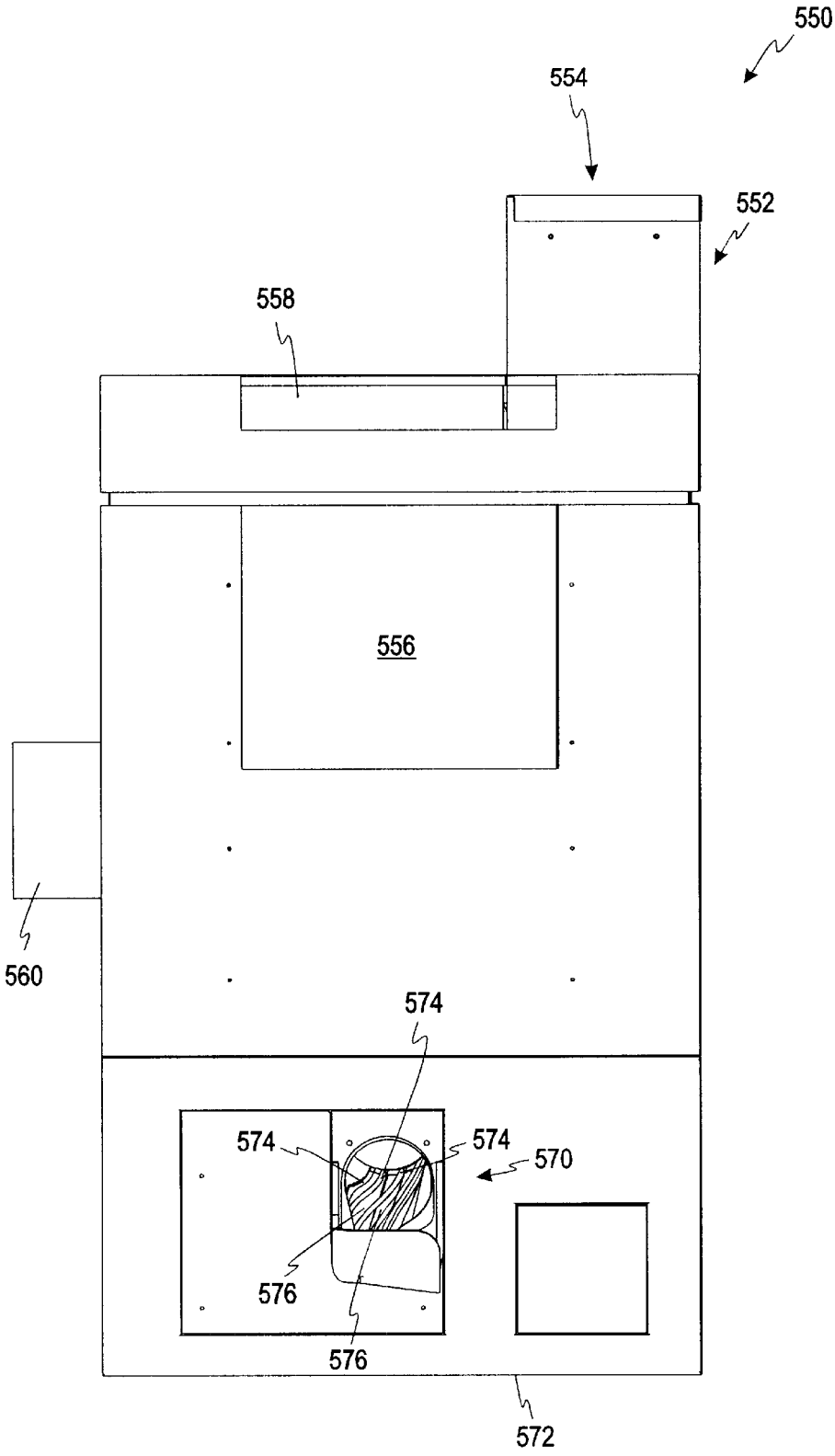
FIG. 30 is a front view of a housing for a coin wrapper according to one embodiment of the present invention.
Figure 31:
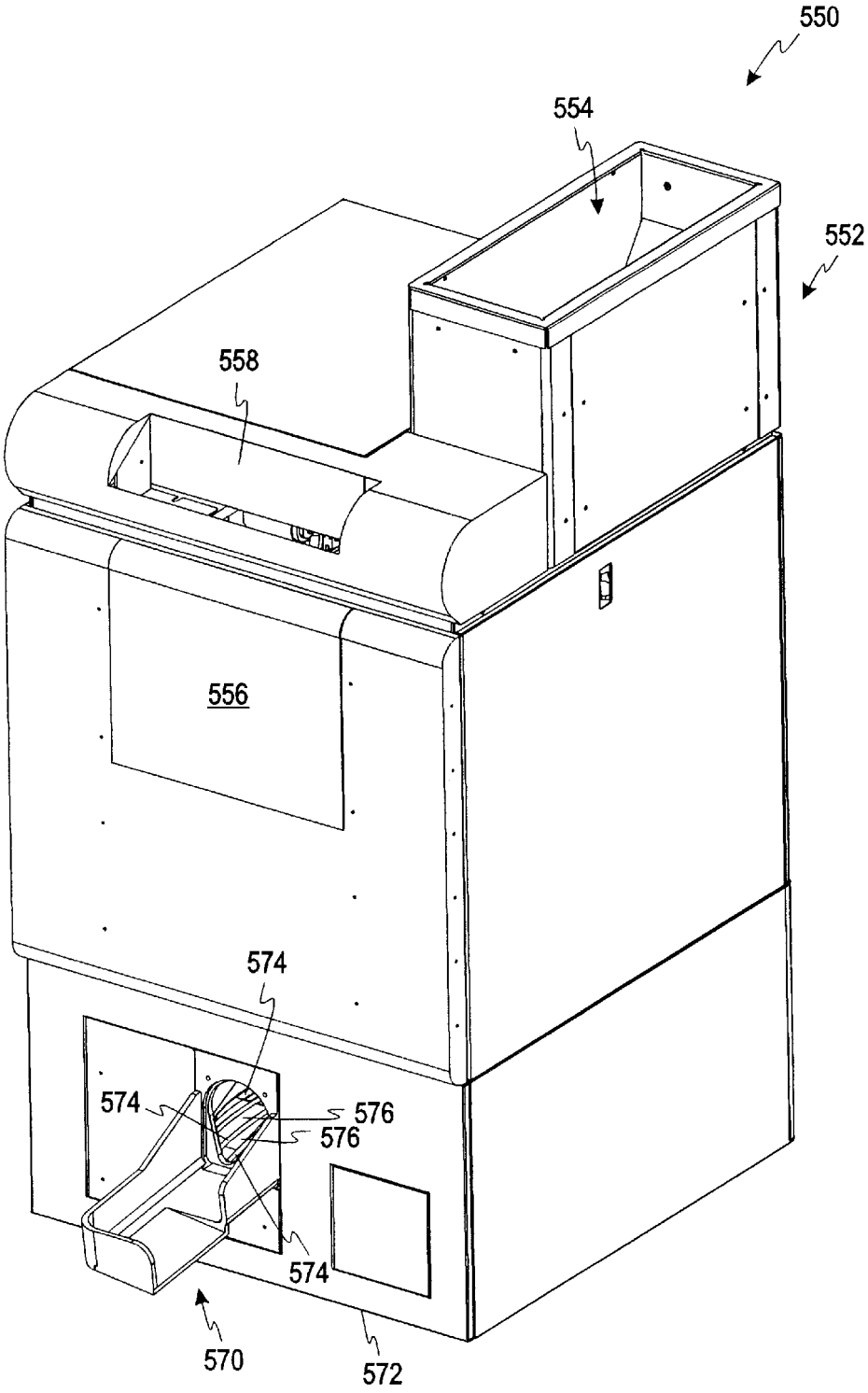
FIG. 31 front perspective view of a housing for a coin wrapper according to one embodiment of the present invention.

Referring now to FIGS. 29–31, one embodiment of the coin wrapper 100 is housed within a housing 550. The housing 100 is made of a rigid material. An upper portion 552 of the housing 550 contain an aperture 554 which is disposed above coin hopper 154. A removable panel 556 gives a user access to the coin wrapper 100. The housing 550 also contains an area 558 for an integral graphical user interface.

The housing 550 also contains a semicircular shaped door 560 behind which the roll 474 of paper 452 is situated. In one embodiment of the present invention, the semicircular door 560 is made out of a clear material allowing the operator to view what denomination of coin wrapping paper is currently within the coin wrapper 100. The semicircular door is removable allowing the operator to more easily change the roll of paper 474 to the appropriate denomination of wrapping paper. In one embodiment of the present invention, the paper roll holder 476 pivots out of the housing when the semicircular door 560 is removed. In another embodiment of the present invention one end 562 of the semicircular door 560 is hingedly mounted to the housing 550 allowing operator to pivot the semicircular door open.

The housing also contains a coin chute 570 disposed near the bottom 572 of the housing 550. The chute 570 is comprised of a plurality of thick wires 574 set apart far enough a distance less than the diameter of the smallest coin stack to create a plurality of slots 576. Having a slotted coin chute 574 prevents the commingling of loose coins and wrapped coins. The slots 576 are wide enough to allow loose coins to fall through while being close enough together to prevent an entire wrapped coin stack from falling though. The thick wires 574 are twisted in a spiral pattern which causes any loose coins to become vertically orientated and fall through the slots 576. The spiral arrangement of the thick wires 574 forces the loose coins to quickly separate from the wrapped coin stacks.

In other alternative embodiments, the user is able to program new modes of operation such as for example a mode of operation corresponding to a new coin denomination or a mode of operation corresponding to the number of coins to be stacked in a single coin stack. In another alternative embodiment of the present invention, the operator inputs the diameter of the coin/token denomination to be wrapped and the coin wrapper 100 make the appropriate spatial adjustments. According to yet a further alternative embodiment of the present invention, the coin wrapper 100 is able to measure the diameter of a coin in a batch of coins to be wrapped and then performs the necessary spatial adjustments.

According to an alternative embodiment of the present invention, a coin wrapper comprises a coin receptacle for receiving the coins, a coin queuing mechanism for receiving the coins from the coin receptacle and moving each of the coins away from the coin receptacle, a coin stacking region, and a coin wrapping region. The coin stacking region includes a stacking element on which coins are stacked to create a coin stack. The coin wrapping region receives the stacking coins on the staking element from the stacking region. The coin wrapping region includes a plurality of rollers for rotating the coin stack and a paper feed mechanism for introducing paper to the coin stack. The paper is wrapped around the coin stack. A controller is electrically coupled to the coin queuing mechanism, the coin stacking region, and the coin wrapping region. The controller controls the operation of the coin queuing mechanism, the stacking element, the plurality of rollers, and the paper feed mechanism. More generally, this alternative embodiment of the present invention is directed to a novel coin wrapping having a stacking element on which coins are stacked which transports stacked coins from a stacking region to a wrapping region.

According to yet a further alternative embodiment of the present invention, a coin wrapper comprises a coin input region for receiving the coins, a coin queuing mechanism for receiving the coins from the coin input region and moving each of the coins away from the coin input region, a coin stacking region for receiving coins from the coin queuing mechanism and stacking the coins on a stacking element to created a coin stack, and a coin wrapping region. The stacking element is moveable between a plurality of set-up positions corresponding to a plurality of denominations to be wrapped. The coin wrapping region receives the coin stack on the stacking element from the stacking region. The coin wrapping region includes a plurality of rollers for rotating the coin stack and a paper feed mechanism for introducing paper to be wrapped around the coin stack. At least one motor is coupled to the stacking element for moving the stacking element among the plurality of set-up positions. A controller is electrically coupled to the motor for controlling the movement of the stacking element among the plurality of set-up positions. More generally, this alternative embodiment of the present invention is directed to a novel stacking region wherein a motor moves a stacking element between a plurality of set-up positions corresponding to a plurality of coin denominations to be wrapped.

According to yet another alternative embodiment of the present invention, a coin wrapper comprises a coin input region for receiving the coins and a coin queuing mechanism for receiving the coins from the coin input region and moving each of the coins away from the coin input region. The coin input region includes a coin table moveable between a plurality of set-up positions corresponding to a plurality of denominations to be wrapped. The coin queuing region includes side walls defining a coin passage that is generally tangential to the coin table. At least one of the side walls is moveable between a plurality of coin passage set-up positions corresponding to a plurality of denominations to be wrapped. A motor is coupled to the coin table and the side walls for moving the coin table and the side walls among the plurality of set-up positions. The coin wrapper also comprises a coin stacking region for receiving coins from the coin queuing mechanism, a coin wrapping region for receiving the coin stack from the coin stacking region. The coin stacking region includes a stacking element on which the coins are stacked to create a coin stack. The coin wrapping region includes a plurality of rollers for rotating the coin stack and a paper feed mechanism for introducing paper to be wrapped around the coin stack. The coin wrapper also includes a controller electrically coupled to the motor. The controller controls the movement of the coin table and the side walls among the plurality of set-up positions. More generally, this alternative embodiment of the present invention is directed to a novel coin table and a novel coin queuing region which are moveable by a motor among a plurality of set-up positions corresponding to a plurality of coin denominations to be wrapped so that the coin queuing region remain generally tangential to the coin table.

According to yet a further alternative embodiment of the present invention, a coin wrapper comprises a coin input region for receiving the coins, a coin queuing mechanism for receiving the coins from the coin input region and moving each of the coins away from the coin input region, a coin stacking region for receiving coins from the coin queuing region and stacking the coins on a stacking element to create a coin stack, a coin wrapping region for receiving the coin stack from the coin stacking region, the coin wrapping region including a plurality of rollers for rotating the coin stack. The coin wrapping region includes a paper feed mechanism for introducing paper to be wrapped around coin stack. The coin stacking region also includes a plurality of guide walls for limiting the radial movement of the coins while being stacked on the stacking element. At least one of the plurality of guide walls is moveable among a plurality of set-up positions corresponding to a plurality of denominations to be wrapped. A motor is coupled to the plurality of guide walls for moving one of the plurality of guide walls among the plurality of set-up positions. A controller is electrically coupled to the motor for controlling the movement of one of the guide walls among the plurality of set-up positions. More generally, this alternative embodiment of the present invention is directed to a novel stacking region having a plurality of guide walls, at least one of which is movable among a plurality of set-up positions corresponding to a plurality of denominations to be wrapped and a motor which is coupled to the one guide wall to move the one guide wall among the plurality of set-up positions.

According to yet a further alternative embodiment of the present invention, a coin wrapper comprises a coin input region for receiving the coins, a coin queuing mechanism for receiving the coins from the coin input region and moving each of the coins away from the coin input region, a coin stacking region for receiving and stacking coins from the coin queuing mechanism and stacking the coins on a stacking element to create a coin stack, a coin wrapping region for receiving a coin stack from the coin stacking region. The coin wrapping region includes a plurality of rollers for rotating the coin stack and a paper feed mechanism for introducing paper to be wrapped around the coin stack. The wrapping region including a plurality of tucker guides for directing the paper around the coin stack. The plurality of tucker guides are moveable among a plurality of set-up positions corresponding to a plurality of coin denominations to be wrapped. A motor is coupled to the plurality of tucker guides for moving the plurality of tucker guides between the plurality of set-up positions. A controller is electrically coupled to the motor for controlling the movement of the plurality of tucker guides among the plurality of set-up positions. More generally, this alternative embodiment of the present invention is directed to a novel wrapping region having a plurality of tucker guides movable among a plurality of set-up positions by a motor coupled to the tucker guides.

According to yet a further alternative embodiment of the present invention, a coin wrapper comprises a coin input region for receiving the coins; a coin queuing mechanism for receiving the coins from the coin input region and moving each of the coins away from the coin input region, a coin stacking region for receiving coins from the coin queuing mechanism and stacking the coins on a stacking element to create a coin stack, and a coin wrapping region for receiving the coin stack from the coin stacking region. The coin wrapping region including a plurality of rollers for rotating the coin stack and a paper feed mechanism for introducing paper to be wrapped around the coin stack. The paper feed mechanism advances a plurality of pre-feed lengths of paper corresponding to a plurality of denominations to be wrapped. A motor is coupled to the paper feed mechanism for advancing the amount of paper. A controller is electrically coupled to the motor for controlling the advancement of the paper. More generally, this alternative embodiment of the present invention is directed to a novel wrapping region having a paper feed mechanism which advances a plurality of pre-feed lengths of paper corresponding to a plurality of denominations to be wrapped and a motor coupled to the paper feed mechanism.

According to yet a further alternative embodiment of the present invention, a coin wrapper comprises a coin input region for receiving the coins, a coin queuing mechanism for receiving the coins from the coin input region and moving each of the coins away from the coin input region, a coin stacking region for receiving coins from the coin queuing mechanism and stacking the coins on a stacking element to create a coin stack, and a coin wrapping region for receiving the coin stack from the coin stacking region. The coin stack has an upper and a lower end. The coin wrapping region includes a plurality of rollers for rotating the coin stack, a paper feed mechanism for introducing paper to be wrapped around the coin stack, and a pair of crimp arms for crimping the paper wrapped around the coin stack at the upper and lower end of the coin stack. The pair of crimp arms are moveable among a plurality of set-up positions corresponding to a plurality of denominations of coins to be wrapped. A motor coupled to the pair of crimp arms for moving the crimp arms among the plurality of start up positions. A controller is electrically coupled to the motor for controlling the movement of the pair of crimp arms among a plurality set-up up positions. More generally, this alternative embodiment of the present invention is directing to a novel wrapping region having a pair of crimp arms for crimping the paper at the top and the bottom of the coin stack. The crimp arms are moveable among a plurality of set up positions by a motor which is coupled to the pair of crimp arms.

According to yet a further alternative embodiment of the present invention, a coin wrapper comprises a coin input region for receiving the coins; a coin queuing mechanism for receiving the coins from the coin input region and moving each of the coins away from the coin input region, a coin stacking region for receiving coins from the coin queuing mechanism and stacking the coins on a stacking element to create a coin stack, and a coin wrapping region for receiving the coin stack from the coin stacking region. The coin queuing mechanism including a top and a bottom defining a coin passage. At least one of the bottom and the top being movable between a plurality of set-up positions corresponding to a plurality of denominations to be wrapped. A motor is coupled to the one of the bottom and the top of the coin passage for moving the top of the coin passage among the plurality of set-up positions. The coin wrapping region includes a plurality of rollers for rotating the coin stack and a paper feed mechanism for introducing paper to be wrapped around the coin stack. A controller is electrically coupled to the motor for controlling movement of the one of the top and the bottom of the coin passage among the plurality of set-up positions. More generally, this alternative embodiment of the present invention is direction to a novel coin queuing mechanism which is adjustable among a plurality of heights corresponding to a plurality of coin denominations to be wrapped and a motor coupled to the top or bottom of the coin queuing mechanism which adjusts the height of the coin queuing mechanism.

According to yet a further alternative embodiment of the present invention, a coin wrapper comprises a coin input region for receiving the coins, a coin queuing mechanism for receiving the coins from the coin input region and moving each of the coins away from the coin input region, a coin stacking region for receiving coins from the coin queuing mechanism and stacking the coins, and a coin wrapping region for receiving stacked coins from the coin stacking region. The coin stacking region including at least two stacking elements wherein the coins are stackable on each of the at least two stacking elements to create a coin stack. Each of the stacking elements have a transverse dimension. The transverse dimension of one of the two stacking elements is larger than the transverse dimension of the other of the two stacking elements. The coin wrapping region includes a plurality of rollers for rotating the coin stack and a paper feed mechanism for introducing paper to be wrapped around the coin stack. More generally, this alternative embodiment of the present invention is directed to a novel stacking region having two stacking elements, one stacking element having a traverse dimension larger than the other.

According to yet a further alternative embodiment of the present invention, a coin wrapper comprises a coin input region for receiving the coins, a coin queuing mechanism for receiving the coins from the coin input region and moving each of the coins away from the coin input region, a coin stacking region for receiving coins from the coin queuing mechanism and for stacking the coins on at least one stacking element to create a coin stack, and a coin wrapping region for receiving the coins on the stacking element from the coin stacking region. The coin wrapping region including a plurality of rollers for rotating the coin stack and a paper feed mechanism for introducing paper to be wrapped around the coin stack. More generally, this alternative embodiment of the present invention is directed to a novel coin wrapper having a stacking element on which coins are stacked that transports coins to the wrapping region and holds the stack while it is being wrapped.

According to yet a further alternative embodiment of the present invention, a coin wrapper comprises a coin input region for receiving the coins, a coin queuing mechanism for receiving the coins from the coin input region and moving each of the coins away from the coin input region, a coin stacking region for receiving coins from the coin queuing mechanism and stacking the coins on a stacking element to create a coin stack, and a coin wrapping region for receiving the stacked coins from the coin stacking region. The coin wrapping region includes a plurality of rollers for rotating the coin stack and a paper feed mechanism for introducing paper to be wrapped around the coin stack. The coin wrapper further comprises at least one arm for reciprocally transporting the stacking element between the stacking region and the wrapping region. The arm is moveable in the horizontal direction and in the vertical direction. A first motor is coupled to the arm for moving the arm in the horizontal direction. A second motor coupled to the arm for moving the arm in the vertical direction. A controller is electrically coupled to the first motor and the second motor. The controller controls the movement of the arm in the horizontal direction and in the vertical direction. More generally, this alternative embodiment of the present invention is directed at a novel coin wrapper having an arm coupled to a stacking element which moves the stacking element in a horizontal and vertical direction as wells as to two motors coupled to that arm for producing that horizontal and vertical movement.

According to yet a further alternative embodiment of the present invention, a coin wrapper comprises a coin input region for receiving the coins, a coin queuing mechanism for receiving the coins from the coin input region and moving each of the coins away from the coin input region, a coin shuttle, a coin stacking region for receiving coins from the coin queuing mechanism and stacking coins on the coin shuttle to create a coin stack, and a coin wrapping region for receiving the coin stack from the coin stacking region. The coin shuttle has a transverse dimension and is horizontally and vertically moveable. The stacking region includes a plurality of guide walls for limiting the radial movement of the coins while being stacked on the stacking element. The plurality of guide walls are moveable among a plurality of positions corresponding to a plurality of denominations to be wrapped. At least one of the guide walls includes a gate disposed therein. The gate is moveable between the open and the closed positions and is biased in the closed position. The gate while in the open position has a width greater than the transverse dimension of the shuttle and permits the horizontal movement of the coin shuttle into the stacking region. The coin wrapping region includes a plurality of rollers for rotating the coin stack and a paper feed mechanism for introducing paper to be wrapped around the coin stack. More generally, this alternative embodiment of the present invention is directed to a novel stacking region have guide walls with a gate disposed therein for permitting the horizontal movement of the coin shuttle into the stacking region.

According to yet a further alternative embodiment of the present invention, a coin wrapper comprises a coin input region for receiving the coins, a coin queuing mechanism for receiving the coins from the coin input region and moving each of the coins away from the coin input region, a coin stacking region for receiving coins from the coin queuing mechanism and stacking coins on a first or a second stacking element to create a coin stack, a coin wrapping region for receiving the coin stack on the first or the second stacking elements from the coin stacking region. The coin wrapping region including a plurality of rollers for rotating the coin stack and a paper feed mechanism for introducing paper to be wrapped around the coin stack. The coin wrapper also comprises a first and a second arm. The first and second arms are coupled to the first and second stacking elements, respectively. The first and second arms are each reciprocally movable between the stacking region and the wrapping region. More generally, this alternative embodiment of the present invention is directed to a novel coin wrapper having two arms which move two coin shuttles between a stacking region and a wrapping region.

According to yet a further alternative embodiment of the present invention, a coin wrapper comprises a coin input region for receiving the coins, a coin queuing mechanism for receiving the coins from the coin input region and moving each of the coins away from the coin input region, a first and a second coin shuttle, a coin stacking region for receiving coins from the coin queuing mechanism and stacking on the first or the second coin shuttles to create a coin stack, a coin wrapping region for receiving the coin stack on the first or the second coin shuttle from the coin stacking region. The coin wrapping region including a plurality of rollers for rotating the coin stack and a paper feed mechanism for introducing paper to be wrapped around the coin stack. The coin wrapper also includes a first arm coupled to the first shuttle which moves move the first shuttle in a horizontal and vertical direction. The coin shuttle also includes a second arm coupled to the second shuttle which moves the second shuttle in a horizontal and a vertical direction. More generally, this alternative embodiment of the present invention is directed to a novel coin wrapper having two coin shuttles which are movable in a horizontal and a vertical direction.

According to yet a further alternative embodiment of the present invention, a coin wrapper comprises a coin input region for receiving the coins, a coin queuing mechanism for receiving the coins from the coin input region and moving each of the coins away from the coin input region, a coin stacking region for receiving coins from the coin queuing mechanism and stacking the coins on a stacking element to create a coin stack, and a coin wrapping region for receiving the coin stack from the coin stacking region. The coin wrapping region including a plurality of rollers for rotating the coin stack and a paper feed mechanism for introducing paper to be wrapped around the coin stack. The coin wrapping region including at least two tucker guides disposed adjacent to the plurality of rollers for directing the paper around the stack of coins. More generally, this alternative embodiment of the present invention is directed to a novel wrapping region having two tucker guides positioned adjacent to the rollers for directing paper around the coin stack.

According to yet a further alternative embodiment of the present invention, a coin wrapper comprises a coin input region for receiving the coins, a coin queuing mechanism for receiving the coins from the coin input region and moving each of the coins away from the coin input region, a coin stacking region for receiving coins from the coin queuing mechanism and stacking the coins on a stacking element to create a coin stack, and a coin wrapping region for receiving the coin stack from the coin stacking region. The coin wrapping region including a plurality of rollers for rotating the coin stack and a paper feed mechanism for introducing paper to be wrapped around the coin stack. The wrapping region including a sheet of fiberglass cloth having a curved shape disposed adjacent to one of the plurality of roller which guides the paper from one of the plurality of rollers to another one of the plurality of rollers. More generally, this alternative embodiment of the present invention is directed at a novel wrapping region having a sheet of fiberglass cloth for guiding the paper between adjacent rollers.

According to yet a further alternative embodiment of the present invention, a coin wrapper comprises a coin input region for receiving the coins, a coin queuing mechanism for receiving the coins from the coin input region and moving each of the coins away from the coin input region, a coin stacking region for receiving coins from the coin queuing mechanism and stacking coins on a stacking element to create a coin stack, a coin wrapping region for receiving the coin stack from the coin stacking region. The coin stack having an upper and a lower end. The coin wrapping region including a plurality of rollers for rotating the coin stack, a paper feed mechanism for introducing paper to be wrapped around the coin stack, and an upper and a lower crimp arm. The upper and lower crimp arms crimps the paper wrapped around the coin stack at the upper and lower ends of the coin stack to create a paper toroid at the upper and lower ends of the coin stack. The upper and lower crimp arms being movable in a direction parallel to an axis of the coin stack and in a radial direction with respect to the axis of the coin stack. At least one motor is coupled to the upper and lower crimp arms to move the upper and lower crimp arm in a direction parallel to an axis of the coin stack and in a radial direction with respect to the axis of the coin stack. A controller is electrically coupled to the motor and controls the moment of the upper and lower crimp arms. More generally, this alternative embodiment of the present invention is directed to a novel wrapping region having a upper and lower crimp arms, both of which are moveable in the direction parallel to an axis of the coin stack and in a radial direction with respect to an axis of the coin stack.

According to yet a further alternative embodiment of the present invention, a coin wrapper comprises a coin input region for receiving the coins, a coin queuing mechanism for receiving the coins from the coin input region and moving each of the coins away from the coin input region, a coin stacking region for receiving coins from the coin queuing mechanism and for stacking the coins on a stacking element to create a coin stack, and a coin wrapping region for receiving the coin stack from the coin stacking region. The queuing mechanism has a terminal end. The coin stacking region includes two guide walls for limiting the radial movement of the coins while being stacked on the stacking element. The two guide walls are disposed apart from each other and generally opposite the queuing region wherein the area bounded by the two guide walls and the terminal end of the coin queuing mechanism is generally triangular in shape. The coin wrapping region includes a plurality of rollers for rotating the coin stack and a paper feed mechanism for introducing paper to be wrapped around the coin stack. More generally, this alternative embodiment of the present invention is directed to a novel stacking region having a triangular shape wherein the stacking region is bounded by the two guide walls and the terminal end of the coin stack.

According to yet a further alternative embodiment of the present invention, a coin wrapper comprises a coin input region for receiving the coins, a coin queuing mechanism for receiving the coins from the coin input region and moving each of the coins away from the coin input region, a coin stacking region for receiving coins from the coin queuing mechanism and for stacking coins on a stacking element to create a coin stack, and a coin wrapping region for receiving the coin stack from the coin stacking region. The coin stack has an upper and a lower end. The coin stacking element has a slot disposed therein extending radially inward from a periphery of the stacking element. The coin wrapping region includes a plurality of rollers for rotating the coin stack, a paper feed mechanism for introducing paper to be wrapped around the coin stack, and an upper and a lower crimp arm for crimping arms being adapted to crimp the paper wrapped around the coin stack at the upper and lower ends of the coin stack to create a paper toroid at the upper and lower ends of the coin stack. The upper and lower crimp arms are movable in a direction parallel to an axis of the coin stack and in a radial direction with respect to the axis of the coin stack. The lower crimp arm is able to move within the slot disposed within the stacking element. More generally, this alternative embodiment of the present invention is directed to a novel stacking element having a slot disposed therein to accommodate a lower crimp arm.

According to yet a further alternative embodiment of the present invention, a coin wrapper comprises a coin input region for receiving the coins, a coin queuing mechanism for receiving the coins from the coin input region and moving each of the coins away from the coin input region, a coin stacking region for receiving coins from the coin queuing mechanism and stacking the coin on a stacking element to create a coin stack, and a coin wrapping region for receiving the coin stack from the coin stacking region. The coin wrapping region includes a plurality of rollers for rotating the coin stack at a plurality of speeds corresponding to a plurality of denominations to be wrapped. The coin wrapping region also includes a paper feed mechanism for introducing paper to be wrapped around the coin stack. A motor is coupled to the plurality of rollers for rotating each of the plurality of rollers at the plurality of speeds. A controller is electrically coupled to the motor for controlling the rotation of the plurality of rollers at the plurality of speeds. More generally, this alternative embodiment of the present invention is directed to a novel wrapping region which operates at a plurality of speeds corresponding to a plurality of coin denominations to be wrapped.

According to yet a further alternative embodiment of the present invention, a coin wrapper comprises a housing, a coin input region within the housing for receiving the coins, a coin queuing mechanism within the housing for receiving the coins from the coin input region and moving each of the coins away from the coin input region, a coin stacking region within the housing for receiving coins from the coin queuing mechanism and for stacking the coins on a stacking element to create a coin stack, and a coin wrapping region within the housing for receiving the coin stack from the coin stacking region. The coin wrapping region including a plurality of rollers for rotating the coin stack, a paper holder which is pivotally moveable out of the housing for receiving a new roll of paper, and a paper feed mechanism for introducing paper from the roll to be wrapped around the coin stack. More generally, this alternative embodiment of the present invention is directed to a novel coin wrapper having a paper holder which pivots out of the coin wrapper housing.

According to yet a further alternative embodiment of the present invention, a coin wrapper comprises a coin input region for receiving the coins, a coin queuing mechanism for receiving the coins from the coin input region and moving each of the coins away from the coin input region, a coin stacking region for receiving coins from the coin queuing mechanism and for stacking the coins on a stacking element to create a coin stack, and a coin wrapping region for receiving the coin stack from the coin stacking region. The coin wrapping region includes a plurality of rollers for rotating the coin stack at a plurality of speeds corresponding to a plurality of coin denominations to be wrapped and a primary pair of paper feed rollers. The primary pair of paper feed rollers introduces paper to the coin stack at one of a plurality of speeds corresponding to a plurality of coin denominations to be wrapped. The paper is introduced to the coin stack at a speed slightly faster than the speed at which the paper circumferentially moves around the coin stack. A first motor is coupled to the plurality of rollers for rotating the coin stack. A second motor is coupled to the primary pair of paper feed rollers for providing movement to the primary feed mechanism. More generally, this alternative embodiment of the present invention is directed to a novel wrapping region which introduces paper to a rotating coin stack at a speed faster than the speed at which the paper circumferentially moves around the coin stack.

According to yet a further alternative embodiment of the present invention, a coin wrapper comprises a coin input region for receiving the coins, a coin queuing mechanism for receiving the coins from the coin input region and moving each of the coins, one at a time, away from the coin input region, a coin stacking region for receiving coins from the coin queuing mechanism and for stacking the coins on a stacking element to create a coin stack, and a coin wrapping region for receiving the coin stack from the coin stacking region. The coin input region includes a coin table moveable between a plurality of set-up positions corresponding to a plurality of denominations to be wrapped. The coin queuing mechanism includes a top and a bottom defining a coin passage. The coin queuing mechanism also includes a belt disposed adjacent to the top or the bottom for moving the coins at a plurality of speeds corresponding to the plurality of denominations to be wrapped. A motor is coupled to the belt for providing movement to the belt at the plurality of speeds corresponding to the plurality of denominations to be wrapped. The coin wrapping region includes a plurality of rollers for rotating the coin stack and a paper feed mechanism for introducing paper to be wrapped around the coin stack. A controller is electrically coupled to the motor for controlling the operation of the belt. More generally, this alternative embodiment of the present invention is directed at a coin queuing mechanism having a belt to move coins at a plurality of speeds corresponding to a plurality of coin denominations to be wrapped.

According to yet a further alternative embodiment of the present invention, a coin wrapper comprises a coin input region for receiving the coins, a coin queuing mechanism for receiving the coins from the coin input region and moving each of the coins away from the coin input region, a coin stacking region for receiving coins from the coin queuing mechanism and for stacking coins on a stacking element to create a coin stack, and a coin wrapping region for receiving the coin stack from the coin stacking region and wrapping paper around the coin stack. The coin wrapping region includes a plurality of rollers for rotating the coin stack and a paper feed mechanism for introducing paper to be wrapped around the coin stack to create a wrapped coin stack. The wrapped coin stack has a diameter. A coin chute is disposed below the wrapping region to direct the wrapped coins stacks under the force of gravity from the wrapping region to an output receptacle. The coin chute has disposed therein a plurality of slots having a width which is smaller than the diameter of the wrapped coin stack. More generally, this alternative embodiment of the present invention is directed to a novel coin wrapper having a coin chute with slots disposed therein which directs wrapped coin stacks to an output receptacle and allows any loose coins to fall through the coin chute so that loose coins are not directed to the output receptacle.

While the invention is susceptible to various modifications and alternative forms, specific embodiments thereof have been shown by way of example in the drawings and will be described in detail herein. It should be understood, however, that it is not intended to limit the invention to the particular forms disclosed, but, to the contrary, the intention is to cover all modifications, equivalents and alternatives falling within the spirit and scope of the invention as defined by the appended claims.

What is claimed is:

1. A method for wrapping coins with a coin wrapper, said coin wrapper including a coin stacking region and a coin wrapping region, said coin wrapping region having a plurality of rollers and a paper feed mechanism, said method comprising:

stacking coins on a first stacking element to create a first coin stack;

moving said first stacking element with the first coin stack thereon to the wrapping region;

wrapping paper around said first coin stack to create a first wrapped coin stack;

stacking coins on a second stacking element to create a second coin stack while wrapping paper around said first coin stack;

removing the first wrapped coin stack from the coin wrapping region;

moving said second stacking element with the second coin stack thereon to the wrapping region;

moving said first stacking element to the stacking region; and wrapping paper around said second coin stack to create a second wrapped coin stack.

2. The method of claim 1 wherein wrapping paper around said first coin stack further comprises crimping the paper at an upper end and a lower end of the first coin stack.

3. The method of claim 1 wherein moving said second stacking element with the second coin stack thereon to the wrapping region further comprises moving the second stacking element in a vertical direction.

4. The method of claim 1 wherein wrapping paper around the second coin stack further comprises rotating said second coin stack.

5. The method of claim 4 wherein rotating said second coin stack further comprises rotating said second coin stack at one of a plurality speeds corresponding to a plurality of coin denominations to be wrapped.

6. The method of claim 1 wherein moving said first stacking element with the first coin stack thereon to the wrapping region further comprises moving the first stacking element in a vertical direction.

7. The method of claim 1 wherein wrapping paper around the first coin stack further comprises rotating said first coin stack.

8. The method of claim 7 wherein rotating said first coin stack further comprises rotating said first coin stack at one of a plurality speeds corresponding to a plurality of coin denominations to be wrapped.

9. A method for wrapping coins with a coin wrapper, said coin wrapper including a coin stacking region having a first and a second coin shuttle, and a coin wrapping region, said coin wrapping region having a plurality of rollers and a paper feed mechanism, said method comprising:

introducing coins to the stacking region one at a time via a coin track, said coins being aligned along said coin track;

stacking coins on said first coin shuttle to create a first coin stack;

moving said first coin shuttle with the first coin stack thereon to the wrapping region;

stacking coins on said second coin shuttle to create a second coin stack;

rotating said first coin stack with said plurality of rollers;

introducing paper to said first coin stack with said paper feed mechanism;

wrapping paper around said first coin stack to create a first wrapped stack of coins;

removing said first wrapped stack of coins from the wrapping region;

moving said second coin shuttle with the second coin stack thereon to the wrapping region;

moving said first coin shuttle from the wrapping region to the stacking region;

rotating said second coin stack with said plurality of rollers;

introducing paper to said second coin stack with said paper feed mechanism;

wrapping paper around said second coin stack to create a second wrapped stack of coins; and removing said second wrapped stack of coins from the wrapping region.

10. The method of claim 9 further comprising moving said second one coin shuttle from the wrapping region to the stacking region.

11. The method of claim 10 wherein moving said second coin shuttle from the wrapping region to the stacking region further comprises:

horizontally moving the second coin shuttle out of the wrapping region;

vertically moving the second coin shuttle; and horizontally moving the second coin shuttle into the stacking region.

12. The method of claim 9 wherein removing said first wrapped stack of coins further comprises directing said first wrapped stack of coins under the force of gravity to an output receptacle.

13. The method of claim 9 wherein removing said second wrapped stack of coins further comprises directing said second wrapped stack of coins under the force of gravity to an output receptacle.

14. The method of claim 9 wherein moving said first coin shuttle with the first coin stack thereon to the wrapping region further comprises moving the first coin shuttle in a vertical direction.

15. The method of claim 9 wherein moving said first coin shuttle from the wrapping region to the stacking region further comprises:

horizontally moving the first coin shuttle out of the wrapping region;

vertically moving the first coin shuttle; and horizontally moving the first coin shuttle into the stacking region.

16. The method of claim 9 wherein moving said second coin shuttle with the second coin stack thereon to the wrapping region further comprises moving the second coin shuttle in a vertical direction.

17. The method of claim 9 wherein moving said first coin shuttle further comprises moving a first arm coupled to the first coin shuttle in a vertical direction.

18. The method of claim 9 wherein moving said second coin shuttle further comprises moving a second arm coupled to the second coin shuttle in a vertical direction.

19. The method of claim 9 wherein introducing said coins to the stacking region further comprises moving the first coin shuttle to one of a plurality of set-up positions corresponding to a plurality of coin denominations to be wrapped.

20. The method of claim 9 wherein introducing said coins to the stacking region further comprises moving the second coin shuttle to one of a plurality of set-up positions corresponding to a plurality of coin denominations to be wrapped.

21. The method of claim 9 wherein introducing said coins to the stacking region further comprises moving the plurality of rollers within the wrapping region to one of a plurality of set-up positions to a plurality of coin denominations to be wrapped.

22. The method of claim 9 wherein introducing said coins to the stacking region further comprises moving a plurality of guide walls within the stacking region to one of a plurality of set-up positions corresponding to one of a plurality of set-up positions.

23. The method of claim 9 wherein rotating said first coin stack further comprises rotating said first coin stack at one of a plurality speeds corresponding to a plurality of coin denominations to be wrapped.

24. The method of claim 9 wherein rotating said second coin stack further comprises rotating said second coin stack at one of a plurality speeds corresponding to a plurality of coin denominations to be wrapped.

25. The method of claim 9 further comprising crimping the paper located at an upper end and a lower end of said first and second wrapped stacks of coins.

26. A method for wrapping coins with a coin wrapper, said coin wrapper including a coin stacking region having at least one coin shuttle, and a coin wrapping region, said coin wrapping region having a plurality of rollers and a paper feed mechanism, said method comprising:

introducing said coins to the stacking region one at a time via a coin track, said coins being axially aligned along said coin track;

stacking said coins on said at least one coin shuttle to create a coin stack;

moving said at least one coin shuttle with the coin stack thereon to the wrapping region;

rotating said coin stack with said plurality of rollers;

introducing paper to said coin stack with said paper feed mechanism;

wrapping said paper around said coin stack to create a wrapped coin stack;

horizontally moving the at least one coin shuttle out of the wrapping region;

vertically moving the at least one coin shuttle; and horizontally moving the at least one coin shuttle into the stacking region.

27. The method of claim 26 further comprising releasing said wrapped coin stack; and directing said wrapped coin stack under the force of gravity to an output receptacle.

28. The method of claim 26 wherein moving said at least one coin shuttle with the coin stack thereon to the wrapping region further comprises moving the at least one coin shuttle in a vertical direction.

29. The method of claim 26 wherein moving said at least one coin shuttle further comprises moving at least one arm coupled to the at least one shuttle in a vertical direction.

30. The method of claim 26 wherein introducing said coins to the stacking region further comprises moving the at least one coin shuttle to one of a plurality of set-up positions corresponding to a one of a plurality of coin denominations to be wrapped.

31. The method of claim 26 wherein introducing said coins to the stacking region further comprises moving the plurality of rollers within the wrapping region to one of a plurality of set-up positions corresponding to one of a plurality of coin denominations to be wrapped.

32. The method of claim 26 wherein introducing said coins to the stacking region further comprises moving a plurality of guide walls within the stacking region to one of a plurality of set-up positions corresponding to one of a plurality of coin denominations to be wrapped.

33. The method of claim 26 wherein rotating said coin stack further comprises rotating said coin stack at one of a plurality speeds corresponding to one of a plurality of coin denominations to be wrapped.

34. The method of claim 26 further comprising crimping the paper located at an upper end and a lower end of the coin stack.

* * * * *